US006761433B2

(12) United States Patent
Moon et al.

(10) Patent No.: US 6,761,433 B2
(45) Date of Patent: Jul. 13, 2004

(54) BUBBLE-JET TYPE INK-JET PRINTHEAD

(75) Inventors: Jae-ho Moon, Suwon (KR); O-hyun Baek, Seoul (KR); Jeong-seon Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 388 days.

(21) Appl. No.: 09/835,349

(22) Filed: Apr. 17, 2001

(65) Prior Publication Data

US 2002/0005878 A1 Jan. 17, 2002

(30) Foreign Application Priority Data

Jul. 11, 2000 (KR) ..... 2000-39554
Nov. 9, 2000 (KR) ..... 2000-66430

(51) Int. Cl.[7] ..... B41J 2/05
(52) U.S. Cl. ..... 347/62; 347/65
(58) Field of Search ..... 347/48, 62, 63, 347/27, 65

(56) References Cited

U.S. PATENT DOCUMENTS

| | | | | |
|---|---|---|---|---|
| 4,580,149 A | | 4/1986 | Domoto et al. | |
| 4,611,219 A | * | 9/1986 | Sugitani et al. | 347/40 |
| 4,914,562 A | | 4/1990 | Abe et al. | |
| 6,003,977 A | * | 12/1999 | Weber et al. | 347/63 |
| 6,354,695 B1 | * | 3/2002 | Kim et al. | 347/48 |
| 2001/0050696 A1 | * | 12/2001 | Suzuki et al. | 347/27 |

FOREIGN PATENT DOCUMENTS

| | | |
|---|---|---|
| EP | 0 354 706 | 2/1990 |
| EP | 0 916 498 | 5/1999 |
| JP | 59-207264 | 11/1984 |
| JP | 61110559 | 5/1986 |
| JP | 61-117205 | 6/1986 |
| JP | 63-023039 | 1/1988 |
| JP | 63-23039 | 2/1988 |
| JP | 63-189243 | 8/1988 |
| JP | 63-251243 | 10/1988 |
| JP | 05-077422 | 3/1993 |
| JP | 06-055735 | 3/1994 |
| JP | 11-170532 | 6/1999 |

* cited by examiner

*Primary Examiner*—John Barlow
*Assistant Examiner*—Michael S. Brooke
(74) *Attorney, Agent, or Firm*—Robert E. Bushnell, Esq.

(57) ABSTRACT

A bubble-jet type ink-jet printhead is provided. The ink-jet printhead includes: a substrate; a nozzle plate including a plurality of nozzles, which is separated a predetermined space from the substrate; walls for closing the space between the substrate and the nozzle plate and then forming a common chamber between the substrate and the nozzle plate; a plurality of resistive layers, formed on the substrate within the common chamber corresponding to the plurality of nozzles, each resistive layer encircling the central axis passing through the center of each nozzle; a plurality of pairs of wiring layers formed on the substrate, each pair of wiring layers being connecting to each resistive layer and extending to the outside of the common chamber; and a plurality of pads which are disposed at the outside of the common chamber on the substrate and electrically connected to the wiring layers. The printhead is constructed such that the space between the nozzle plate and the substrate forms a common chamber and there is no ink channel having a complicated structure, thereby significantly suppressing clogging of nozzles by foreign materials or solidified ink. The printhead is easy to design and manufacture due to its simple structure, thereby significantly reducing the manufacturing cost. In particular, its simple structure permits flexibility in selecting a wide range of alternative designs and thus patterns in which the nozzles are arranged. Furthermore, the printhead can be manufactured by a fabrication process for a typical semiconductor device, thereby facilitating high volume production.

26 Claims, 23 Drawing Sheets

BUBBLE-JET TYPE INK-JET PRINTHEAD

This application makes reference to, incorporates the same herein, and claims all benefits accruing under 35 U.S.C. §119 from my applications entitled BUBBLE-JET TYPE INK-JET PRINT HEAD filed with the Korean Industrial Property Office on Jul. 11, 2000 and there duly assigned Serial No. 2000-39554 and entitled BUBBLE-JET TYPE INK-JET PRINT HEAD filed with the Korean Industrial Property Office on Nov. 9, 2000 and there duly assigned Serial No. 2000-66430.

BACKGROUND OF THE INVENTION

1. Field of the Invention

The present invention relates to an ink-jet printhead, and more particularly, to a bubble-jet type ink-jet printhead.

2. Description of the Related Art

The ink ejection mechanisms of an ink-jet printer are largely categorized into two types: an electro-thermal transducer type (bubble-jet type) in which a heat source is employed to form a bubble in ink causing ink droplets to be ejected, and an electromechanical transducer type in which a piezoelectric crystal bends to change the volume of ink causing ink droplets to be expelled.

An ink-jet printhead having a bubble-jet type ink ejector needs to meet the following conditions. First, a simplified manufacturing procedure, low manufacturing cost, and high volume production must be allowed. Second, to produce high quality color images, creation of minute satellite droplets that trail ejected main droplets must be prevented. Third, when ink is ejected from one nozzle or ink refills an ink chamber after ink ejection, cross-talk with adjacent nozzles from which no ink is ejected must be prevented. Fourth, for a high speed print, a cycle beginning with ink ejection and ending with ink refill must be as short as possible. Fifth, a nozzle and an ink channel for introducing ink into the nozzle must not be clogged by foreign materials or solidified ink.

However, the above conditions tend to conflict with one another, and furthermore, the performance of an ink-jet printhead is closely associated with structures of an ink chamber, an ink channel, and a heater, the type of formation and expansion of bubbles, and the relative size of each component. Thus, due to the complicated structures of ink-jet printheads, the fabrication process is very complex and the manufacturing cost is very high. Furthermore, each ink channel having a complicated structure has a different fluid resistance to ink supplied to each chamber, which results in large differences in the amount of ink supplied to each chamber. Thus, this raises design concerns for adjusting the difference. Due to the complicated structures of the ink channel and ink chamber connected thereto, foreign materials may adhere to the ink channel and ink chamber or ink may solidify, which may not only cause an obstacle to supplying ink to the ink chamber but may also clog the ink channel or the nozzle rendering it unusable.

Meanwhile, an ink-jet printhead disclosed in U.S. Pat. No. 4,847,630 is constructed such that an annular heater surrounding each nozzle, from which ink is ejected, is formed in a nozzle plate, and a C-shaped isolation wall, one side of which is open, is disposed in the vicinity of the heater. The ink-jet print head printhead constructed such that the heater and the isolation wall are formed in the same nozzle plate is advantageous in reducing offset between the nozzle and the heater. However, heat loss due to the nozzle plate is large and the structure is complicated since the ink chamber formed by the isolation wall is provided for each nozzle.

SUMMARY OF THE INVENTION

To solve the above problems, it is an objective of the present invention to provide a bubble-jet type ink-jet printhead having a simplified structure which is simple to manufacture.

It is another objective of the present invention to provide a bubble-jet type ink-jet printhead which is capable of effectively preventing adhesion of foreign materials and ink solidification.

It is still another objective of the present invention to provide a bubble-jet type ink-jet printhead which has a low manufacturing cost and a long lifetime.

It is still another objective of the invention to provide a bubble-jet type ink-jet printhead having a self-cleaning function.

It is further an object of the present invention to provide a bubble-jet type ink-jet printhead which has little or no crosstalk between the nozzles.

It is also an object of the present invention to provide a bubble-jet type ink-jet printhead that can eject a droplet of ink without ejecting satellite droplets.

Accordingly, to achieve the above objectives, the present invention provides a bubble-jet type ink jet printhead which includes a substrate, a nozzle plate including a plurality of nozzles, which is separated a predetermined space from the substrate, walls for closing the space between the substrate and the nozzle plate and then forming a common chamber between the substrate and the nozzle plate, a plurality of resistive layers, formed on the substrate within the common chamber corresponding to the plurality of nozzles, each resistive layer encircling the central axis passing through the center of each nozzle, a plurality of pairs of wiring layers formed on the substrate, each pair of wiring layers being connecting to each resistive layer and extending to the outside of the common chamber, and a plurality of pads which are disposed at the outside of the common chamber on the substrate and electrically connected to the wiring layers.

Preferably, the plurality of resistive layers and the plurality of nozzles corresponding thereto are formed in two or more rows on the substrate and the nozzle plate, respectively. Preferably, a dam for dividing the common chamber into a plurality of regions and allowing ink to flow from one region to another by spatially connecting the plurality of regions is disposed within the common chamber, wherein the dam has a height smaller than the distance between the substrate and the nozzle plate. Furthermore, the dam is of a stack-type, which is stacked on the substrate, and/or of a rib-type dam which projects inwardly toward the substrate from the nozzle plate. Preferably, the resistive layer is formed in a doughnut-shape, one side of which is open, or an omega shape. A damping hole adjacent to each of the plurality of nozzles is formed in the nozzle plate, and in particular, the damping hole is formed between adjacent nozzles. Furthermore, preferably, one or more common chambers are arranged between the substrate and the nozzle plate, each common chamber being spatially isolated, and ink feed grooves are formed at two opposite ends of the substrate for supplying ink to both sides of the common chamber.

The present invention also provides a bubble-jet type ink-jet printhead which includes a substrate, a nozzle plate including a plurality of nozzles, which is separated a predetermined space from the substrate, walls for closing the space between the substrate and the nozzle plate and then forming a common chamber between the substrate and the nozzle plate, concave portions formed on the substrate corresponding to the nozzles, a plurality of resistive layers formed in the concave portions of the substrate within the common chamber corresponding to the plurality of nozzles, each resistive layer encircling the central axis passing through the center of each nozzle, a plurality of pairs of wiring layers formed on the substrate, each pair of wiring layers being connecting to each resistive layer and extending to the outside of the common chamber; and a plurality of pads which are disposed at the outside of the common chamber on is the substrate and electrically connected to the wiring layers.

Preferably, in the ink-jet printhead, a thermal insulating layer is formed on the substrate and the resistive layer is formed on the thermal insulating layer. A protective layer for protecting the resistive layer from ink within the common chamber is formed on the resistive layer. Furthermore, the diameter of the lower portion of the nozzle that faces the common chamber is greater than or equal to the diameter of the concave portion, on which the resistive layer is formed, and it is greater than the distance between the distance between the substrate and the nozzle plate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIGS. 20 and 21 are schematic cross-sectional views of a substrate of a bubble-jet type ink-jet printhead according to a sixth embodiment of the present invention, of which FIG. 20 shows a normal state before ink ejection, and FIG. 21 shows a state when ink ejection occurs;

DETAILED DESCRIPTION OF THE INVENTION

Figure 1A:
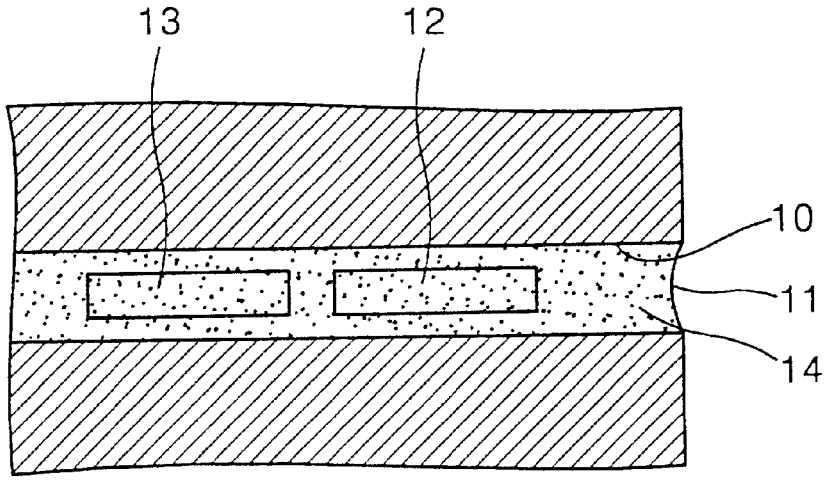
FIGS. 1A and 1B are cross-sectional views showing the structure of a bubble-jet ink jet printhead along with an ink ejection mechanism.
Figure 1B:
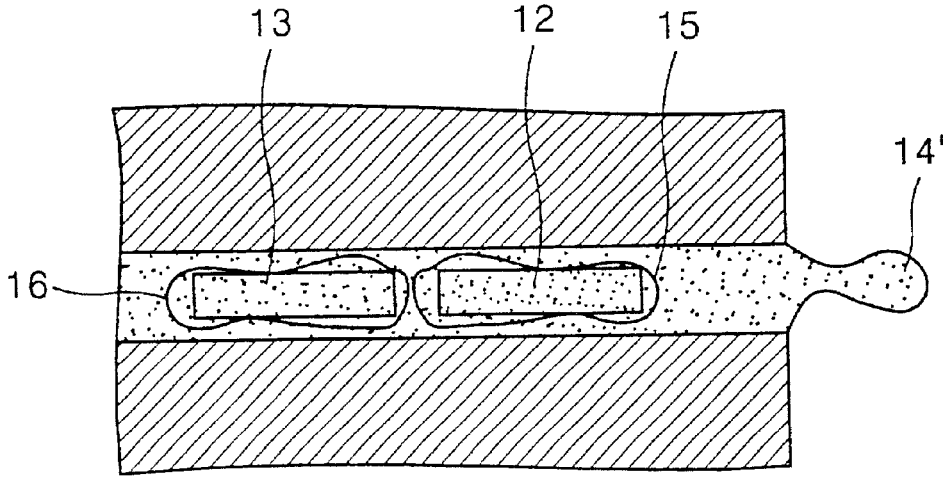

Referring to FIGS. 1A and 1B, a bubble-jet type ink ejection mechanism will now be described. When a current pulse is applied to a first heater 12 consisting of resistive heating elements formed in an ink channel 10 where a nozzle 11 is located, heat generated by the first heater 12 boils ink 14 to form a bubble 15 within the ink channel 10, which causes an ink droplet 14' to be ejected.

In FIGS. 1A and 1B, a second heater 13 is provided so as to prevent a back flow of the ink 14. First, the second heater 13 generates heat, which causes a bubble 16 to shut off the ink channel 10 behind the first heater 10. Then, the first heater 12 generates heat and the bubble 15 expands to cause the ink droplet 14' to be ejected.

In efforts to overcome problems related to the above requirements, ink-jet print heads having a variety of structures have been proposed in U.S. Pat. Nos. 4,339,762; 4,882,595; 5,760,804; 4,847,630; and 5,850,241, European Patent No. 317,171, and Fan-Gang Tseng, Chang-Jin Kim, and Chih-Ming Ho, "A Novel Micoinjector with Virtual Chamber Neck", IEEE MEMS '98, pp. 57–62. However, ink-jet printheads proposed in the above patents and literature may satisfy some of the aforementioned requirements but do not completely provide an improved ink-jet printing approach.

Figure 2:
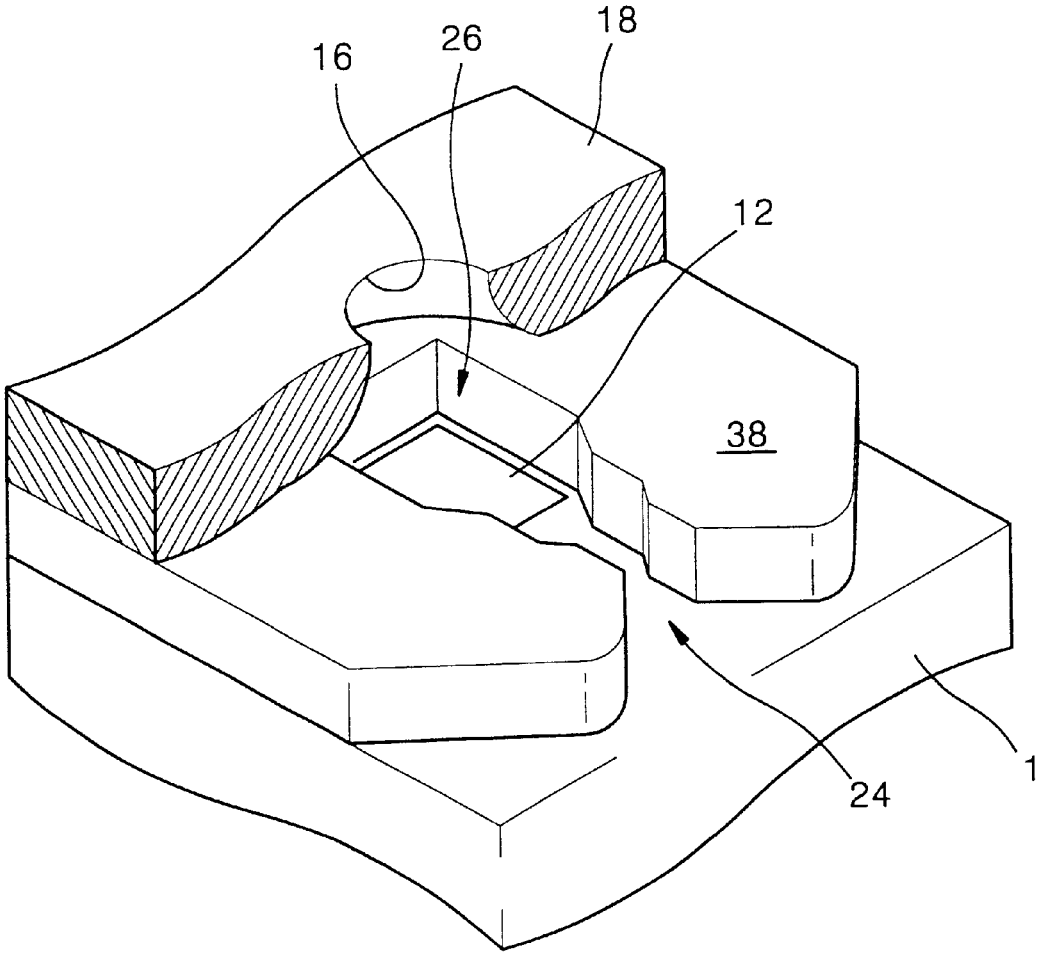
FIG. 2 (PRIOR ART)
FIG. 2 is a perspective view of a portion of a conventional bubble-jet type ink-jet printhead.

FIG. 2 is an extract drawing showing an ink-jet printhead disclosed in U.S. Pat. No. 4,882,595. Referring to FIG. 2, a chamber 26 for providing for a space where a heater 12 formed on a substrate 1 is located, and an intermediate layer_38 for forming an ink channel 24 for introducing ink into the chamber 26 are provided. A nozzle plate 18 having a nozzle 16 corresponding to the chamber 26 is disposed on the intermediate layer 38.

Figure 3:
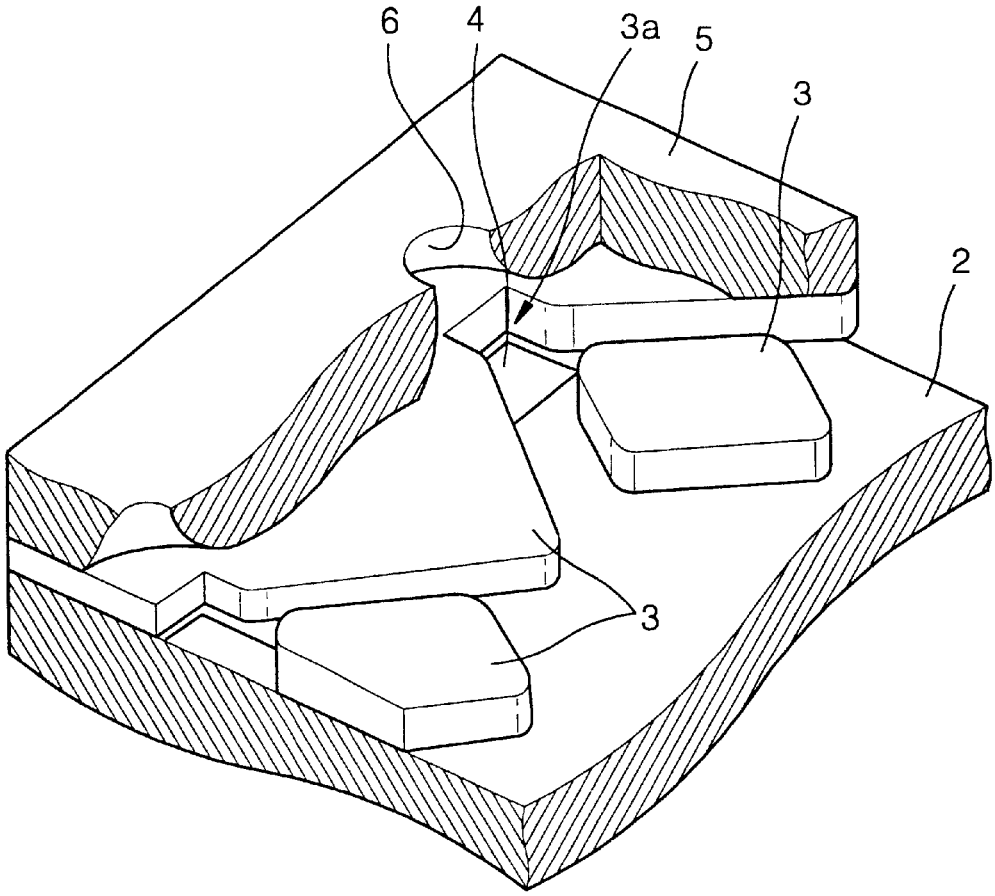
FIG. 3 (PRIOR ART)
FIG. 3 is a perspective view of a portion of a conventional bubble-jet type ink-jet printhead.

FIG. 3 is an extract drawing showing an ink-jet printhead disclosed in U.S. Pat. No. 5,912,685. Referring to FIG. 3, a chamber 3*a* in which a heater resistor 4 is disposed, and an intermediate layer 3 for offering an ink channel for introducing ink into the ink chamber 3*a* are disposed on a substrate 2. A nozzle plate 5 including a nozzle 6 corresponding to the chamber 3*a* is formed on the intermediate layer 3.

In the ink-jet printheads disclosed in the above-cited references including the conventional ink-jet printheads shown in FIGS. 2 and 3, one chamber is allocated for each nozzle and an ink channel having a complicated structure is provided for supplying ink from an ink feed cartridge to each chamber.

Figure 4:
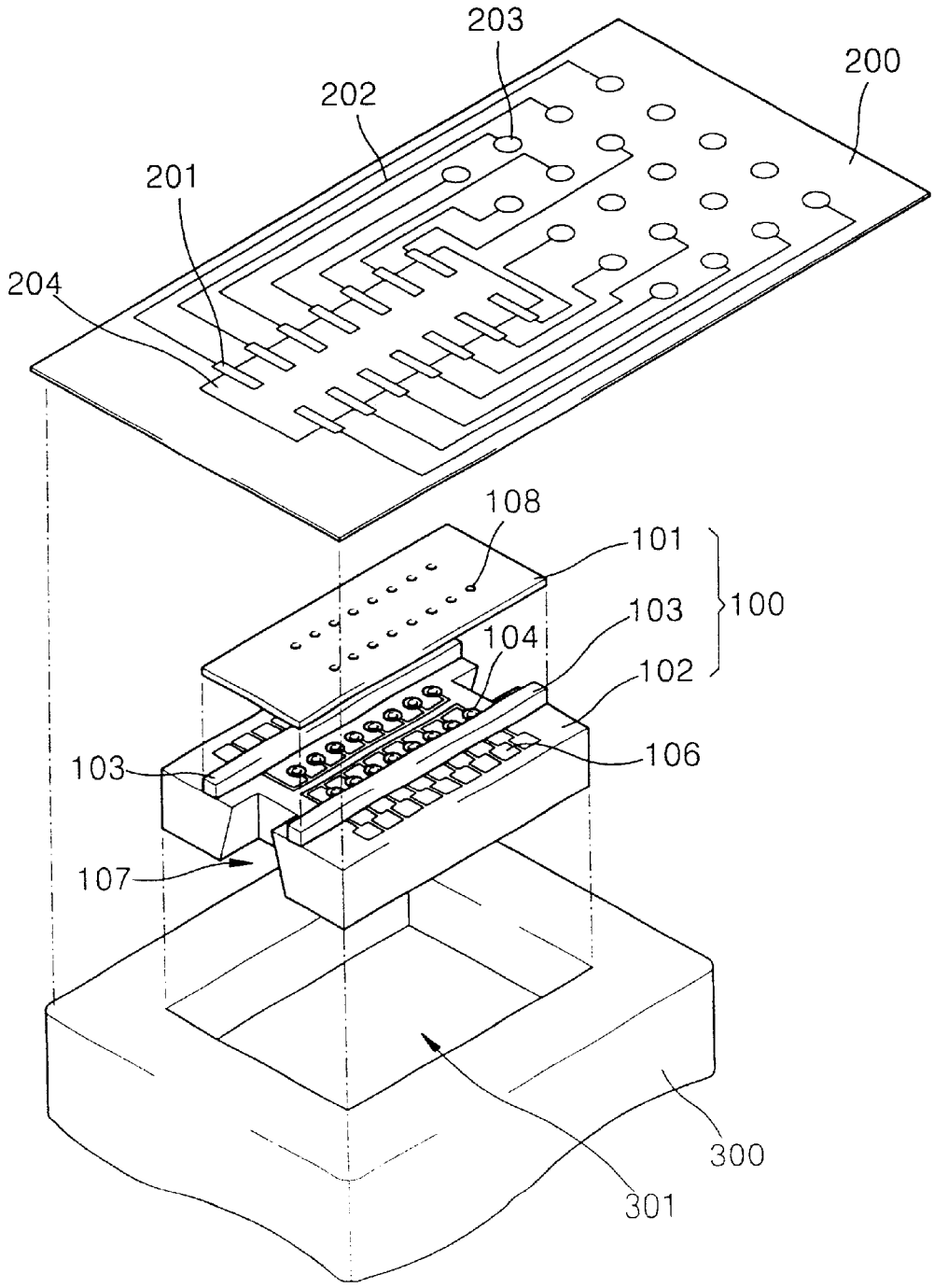
FIG. 4 is an exploded perspective view showing the schematic structure of an ink-jet cartridge, to which a bubble-jet type ink-jet printhead according to a first embodiment of the present invention is applied.
Figure 5A:
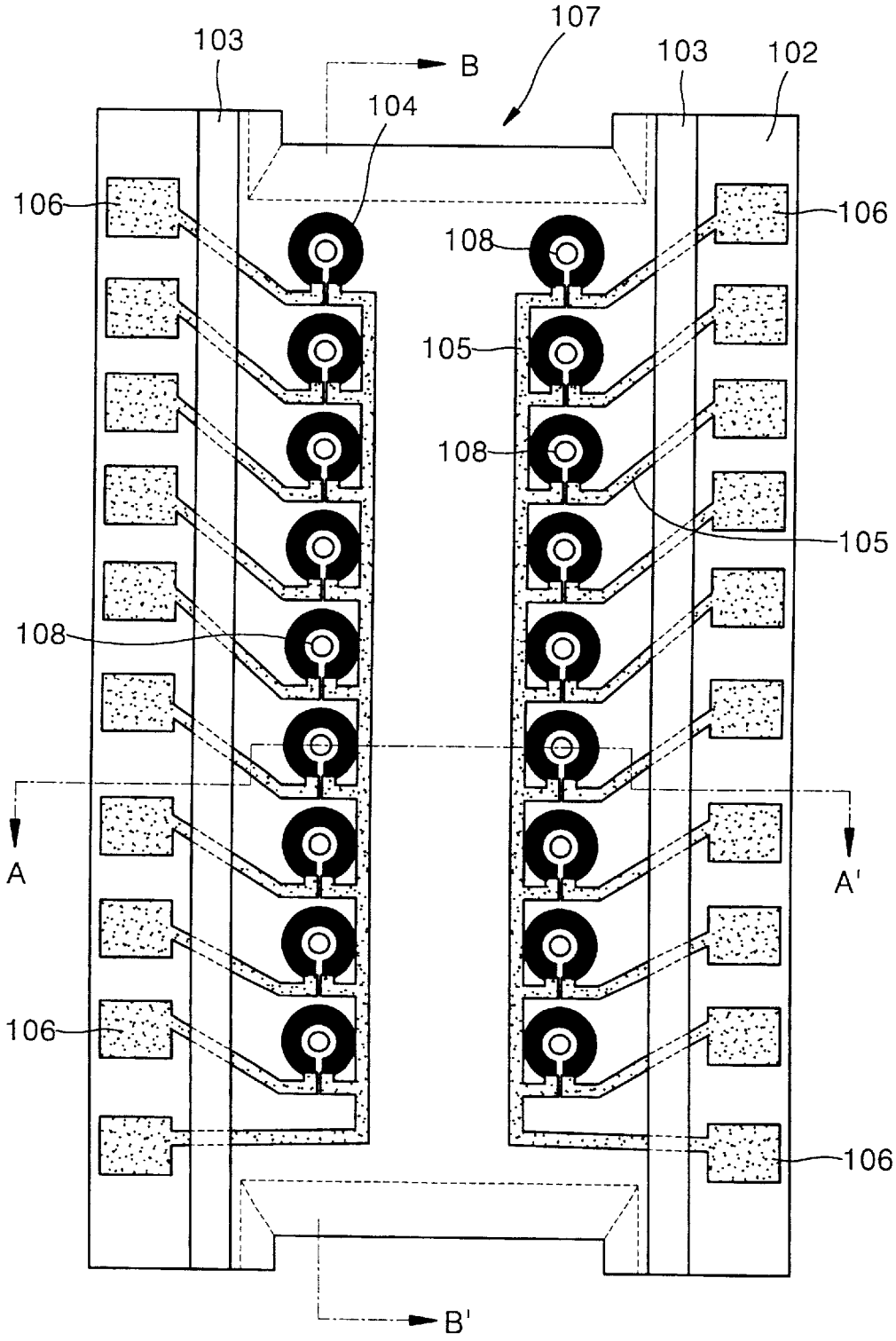
FIG. 5A is a schematic top view showing the state in which a nozzle plate is not provided in the bubble-jet type ink-jet printhead according to the present invention shown in FIG. 4.

Referring to FIGS. 4 and 5A, a head mount portion 301 is disposed at the upper center of a cartridge 300 for supplying ink. A head 100 according to the present invention is inserted into the head mount portion 301. The head 100 includes a substrate 102 and a nozzle plate 101. Walls 103 having a predetermined height are arranged at regular intervals on the substrate 102, and ink feed grooves 107 are formed at the center portions of either end in the direction in which the walls 103 extend. The wall 103 separates the substrate 102 and the nozzle plate 101 by a predetermined distance, between which a common chamber that will be described below is formed. A plurality of omega-shaped resistive layers 104 are disposed at the bottom of the common chamber.

Figure 5B:
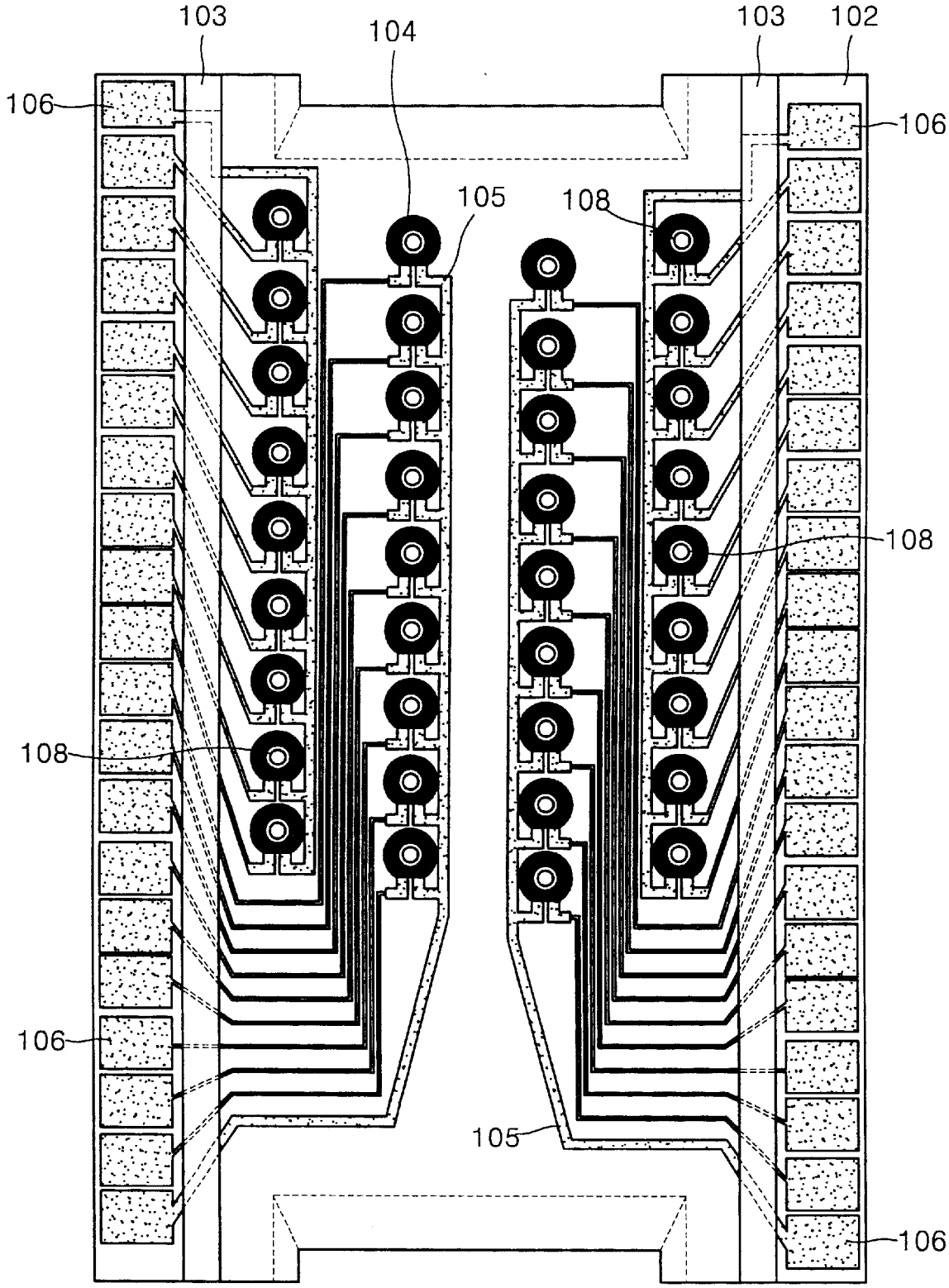
FIG. 5B is a schematic top view of a substrate of a bubble-jet type ink-jet printhead according to a second embodiment of the present invention.

Each resistive layer 104 is formed in such a way as to encircle a central axis passing through the center of each nozzle 108 formed in the nozzle plate 101. The nozzle 108 and the resistive layer 104 are arranged in this way so as to form a virtual chamber for each nozzle 108 by a doughnut-shaped bubble, which will be described below. The resistive layers 104 are arranged in two rows in a direction parallel to the walls 103. In this embodiment, the nozzles 108 and the resistive layers 104 associated therewith are arranged in two rows, respectively, but they may be arranged in one row. In order to achieve high resolution, they may be arranged in three rows, or in four or more rows like in a bubble-jet type ink-jet printhead according to a second embodiment of the present invention shown in FIG. 5B.

Meanwhile, a plurality of electrically conductive layers 105 are connected to the resistive layers 104, and the wiring layers 105 extend to the outside of both walls 103, where they are coupled to a plurality of pads 106. Each pad 106 on the substrate 100 contacts each terminal 201 disposed on a flexible printed circuit (FPC) board 200. An opening 204 for penetrating the head 100 is also disposed on the FPC board 200. Here, the pads disposed on the substrate 100 correspond one-to-one to the terminals 201 disposed on the FPC board. Further, each terminal 201 on the FPC board 200 is connected to a corresponding contact terminal 203 through a conductive layer 202. When the cartridge 300 is mounted to a head transport device of an ink-jet printer, each contact terminal 203 is in contact with each terminal (not shown) disposed in the head transport device.

Figure 6:
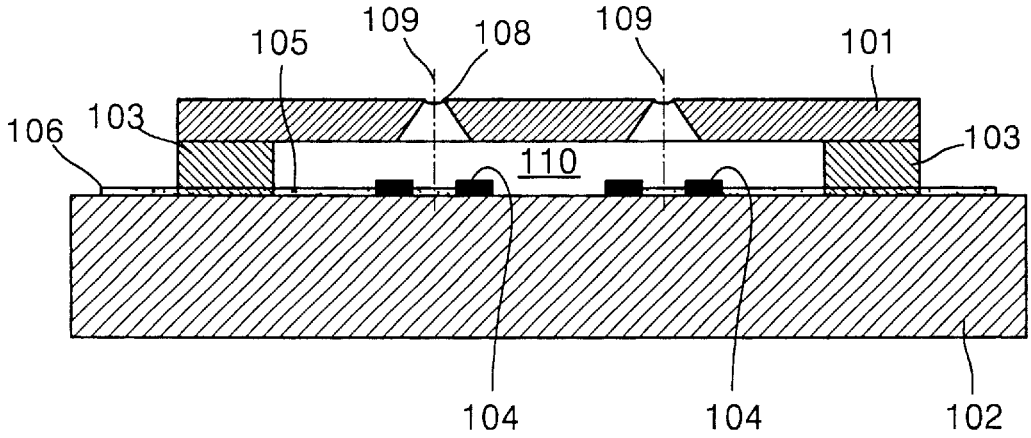
FIGS. 6 and 7 are cross-sectional views of the bubble-jet type ink-jet printhead according to the present invention taken along lines A–A' and B–B' of FIG. 5A, respectively.
Figure 7:
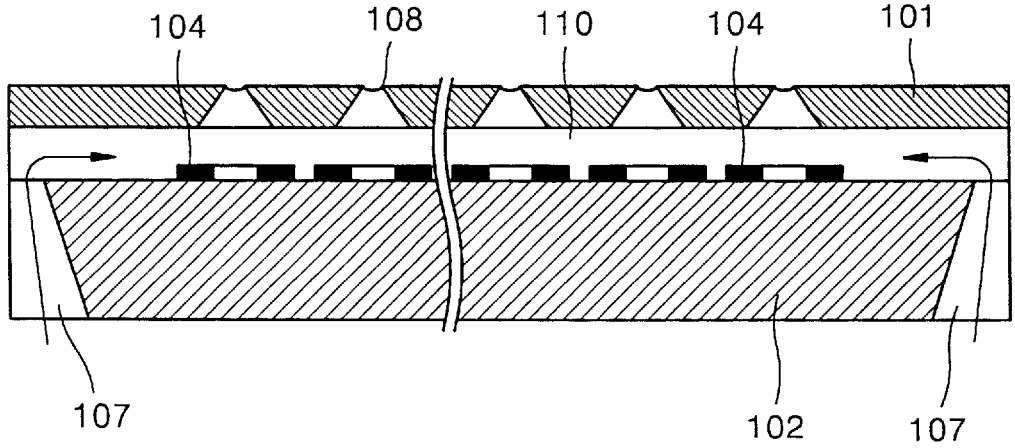

FIGS. 6 and 7 are cross-sectional views of the ink-jet printhead according to the first embodiment of the present invention taken along lines A–A' and B–B'. As shown in FIGS. 6 and 7, a common chamber 110 is formed in a space between the substrate 102 and the nozzle plate 101 formed by both walls 103. As previously mentioned, the resistive layer having a doughnut shape, one side of which is open, (an omega shape) is formed in such a way as to surround the center axis of the nozzle 108. The resistive layer 104 is formed corresponding to each nozzle 108. As shown in FIG. 7, the ink feed grooves 107 are provided at either end of the substrate 102.

Figure 8:
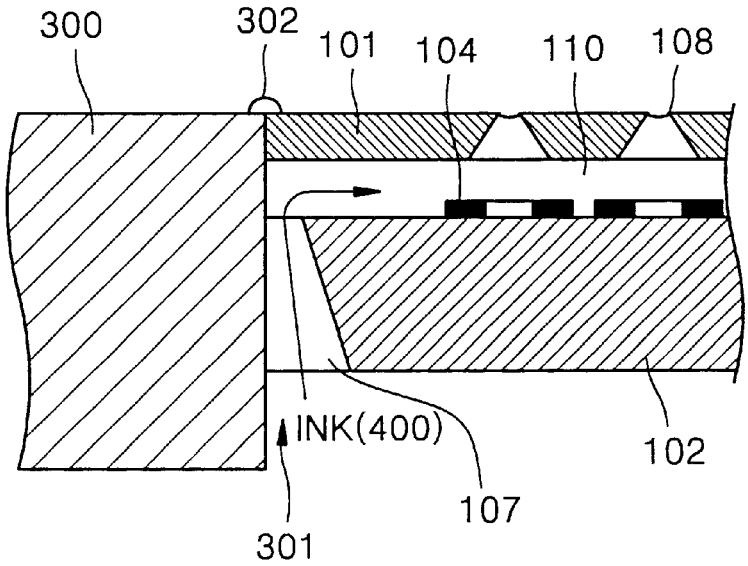
FIG. 8 is a cross-sectional view of a portion of a bubble-jet type ink-jet printhead cartridge shown in FIG. 4.

The ends of the common chamber 110 are not sealed by the wall 103. However, as shown in FIG. 8, when the head 100 is inserted into the head mount portion 301 of the cartridge 300, the ends of the common chamber 110 are sealed by a sealing portion 302. Thus, the ink feed groove 107 is connected with the inside of the cartridge 300 for supplying ink 400.

Figure 9:
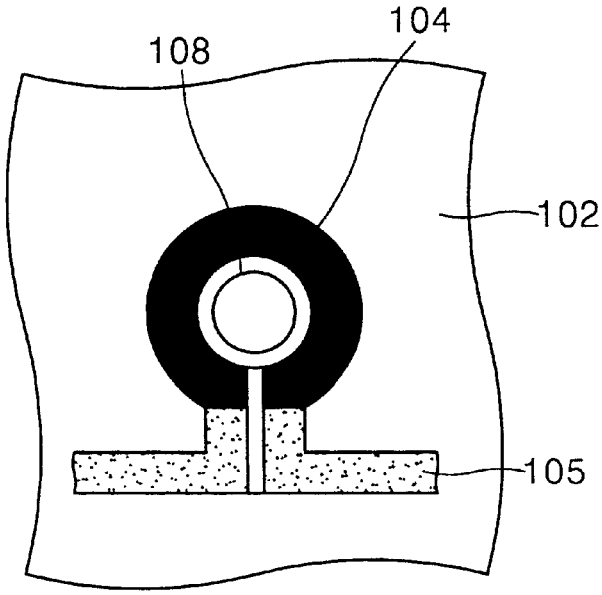
FIG. 9 is a top view showing the relationship between a resistive layer formed on the substrate and a corresponding nozzle in a bubble-jet type ink-jet printhead according to the present invention.
Figure 10:
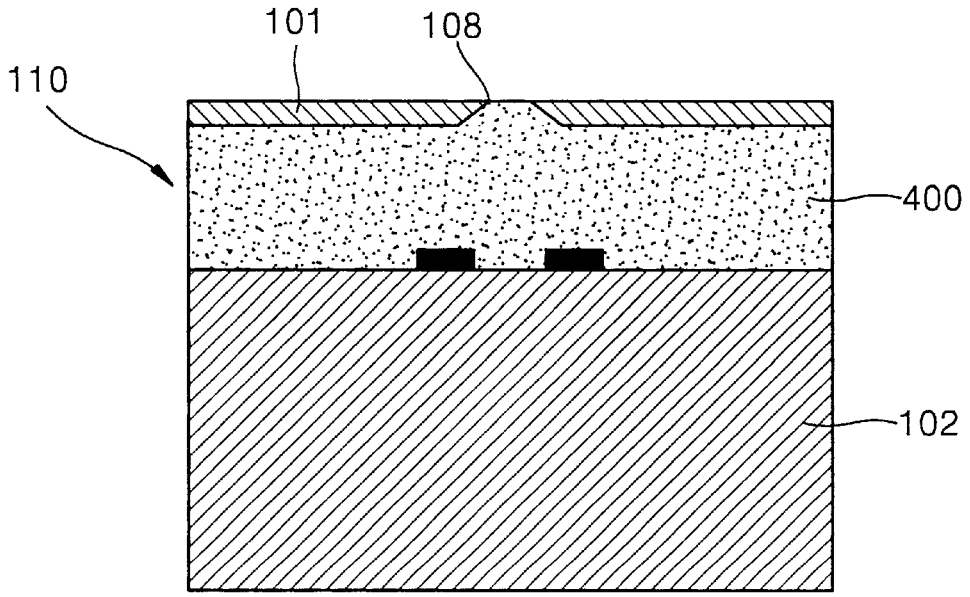
FIGS. 10–13 are schematic cross-sectional views showing the formation and growth of a doughnut-shaped bubble, ejection of an ink droplet, and shrinkage of the bubble in a bubble-jet type ink-jet printhead according to the present invention.

A process of ejecting ink for a bubble-jet type ink-jet-printhead according to the present invention having the above structure will now be described. FIG. 9 shows a resistive layer 104 and a nozzle 108 disposed coaxially inside the resistive layer 104. FIGS. 10–13 show steps of the formation of a doughnut-shaped bubble due to heat from the resistive layer, growth of the bubble, ejection of an ink droplet, shrinkage of the bubble, and refill of ink. First, as shown in FIG. 9, the resistive layer 104 is arranged in such a way as to encircle an axis passing through the center of the nozzle 108. Thus, if a DC pulse is applied to the resistive layer 104, heat rapidly generated from the resistive layer 104 boils ink, thereby forming a doughnut-shaped bubble corresponding to the shape of the resistive layer 104. FIG. 10 shows a state in which the resistive layer 104 is electrically unloaded. In this case, the ink 400 fills the common chamber 110. The ink is supplied to the common chamber by capillary action.

Figure 11:
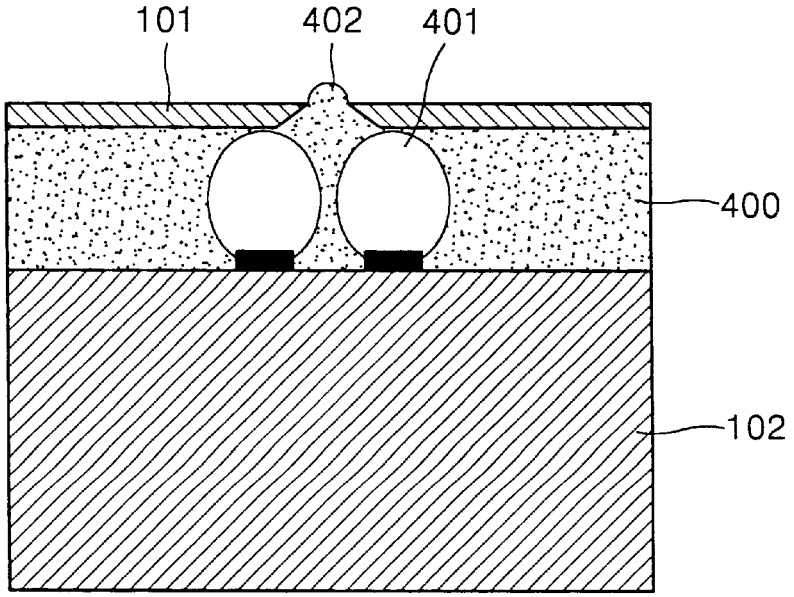

FIG. 11 shows a state in which a doughnut-shaped bubble 401 is formed by the resistive layer 104, to which the DC pulse is applied. As shown in FIG. 11, the ink 400 below the nozzle 108 is isolated and then compressed by the bubble 401. Thus, the doughnut-shaped bubble 401 creates an isolated virtual chamber within the common chamber 110 shared by the nozzles 108, and exerts pressure on the ink 400 within the virtual chamber to cause the ink to be ejected through the corresponding nozzle 108.

Figure 12:
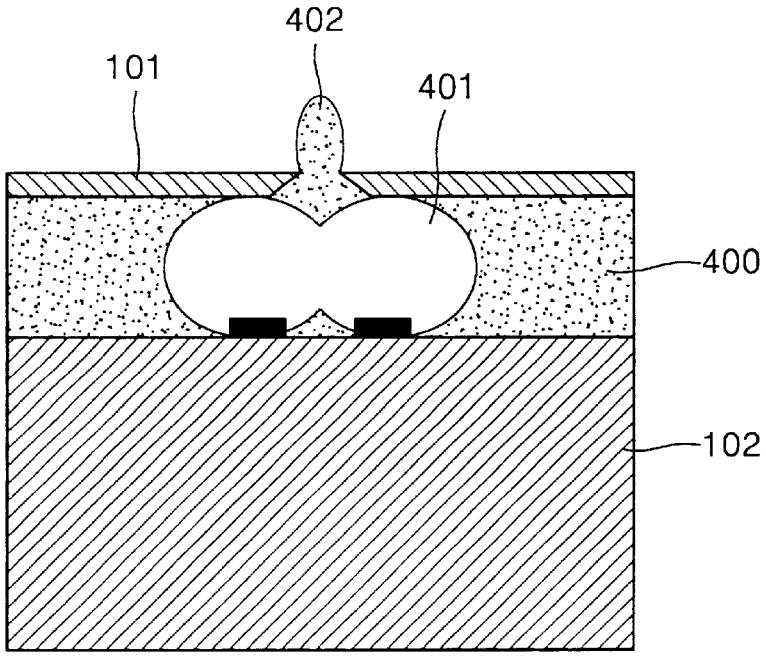
Figure 13:
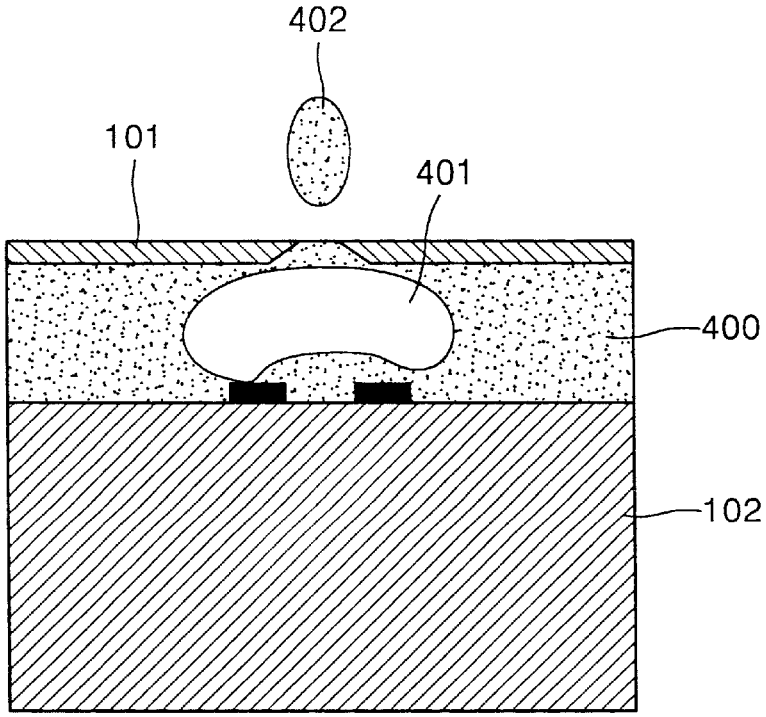

FIG. 12 shows a state in which the doughnut-shaped bubble 401 has reached its maximum growth. The virtual chamber formed by the doughnut-shaped bubble 401 is reduced to a minimum by the maximum growth of the doughnut-shaped bubble 401, thus causing a droplet 402 of the ink 400 within the virtual chamber to exit through the nozzle 108. FIG. 13 is a state in which the bubble 401 is shrunk after ejection of the ink droplet 402 through the nozzle 108. As the bubble 401 shrinks, the ink 400 begins to refill, which returns to the state shown in FIG. 10. The shrinkage of the bubble 401 is attributed to the cooling of the resistive layer 104 due to the cutoff of the DC pulse.

According to the present invention described above, the virtual chamber is formed by the doughnut-shaped bubble 401 to spatially separate the ink 400 to be ejected through the nozzle 108. The tail of the ink droplet 402 ejected by reduction in the virtual chamber due to the maximum growth of the bubble 401 is cut off to prevent the formation of a satellite droplet. Furthermore, the area of the annular heater 104 is so wide as to be rapidly heated and cooled, which quickens the cycle from the formation to the collapse of the bubble 401, thereby allowing for a quick response rate and high driving frequency.

Figure 14:
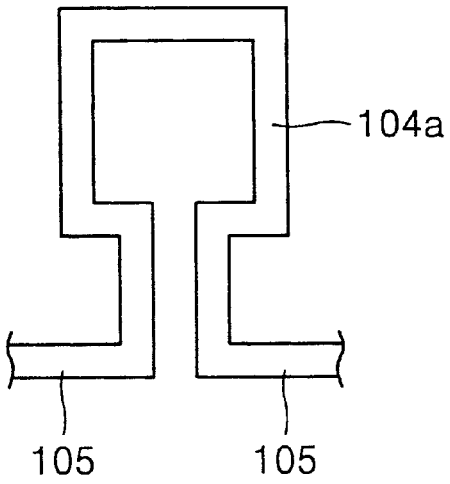
FIGS. 14 and 15 show a modified example of a resistive layer of a bubble-jet type ink-jet printhead according to the present invention.
Figure 15:
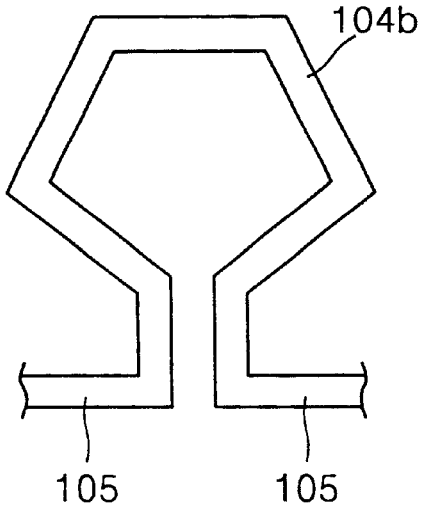

In this embodiment, the doughnut-shaped resistive layer 104 can be modified into another form. For example, the doughnut-shaped resistive layer 104 may be replaced with a resistive layer 104*a* having a rectangular frame as shown in FIG. 14 or a resistive layer 104*b* having a pentagonal frame as shown in FIG. 15. Thus, the shape of the resistive layers 104, 104*a*, and 104*b* does not restrict the technical scope of the present invention.

In the ink-jet printhead according to the present invention, the resistive layer 104 surrounds the central axis of the nozzle 108 associated therewith by a predetermined space, and thus the resistive layer 104 may take on a variety of different forms so as to create a virtual chamber spatially separated from another region within the common chamber 110 by the bubble 401 formed corresponding to the shape of the resistive layer 104.

Meanwhile, the common chamber 110 can be divided into a plurality of regions. Due to this division of the common chamber 110, one region is not completely separated from another region. Rather, the flow of the ink 400 is guided between divided regions and predetermined resistance is imparted to an ink flow from one region to another.

Figure 16:
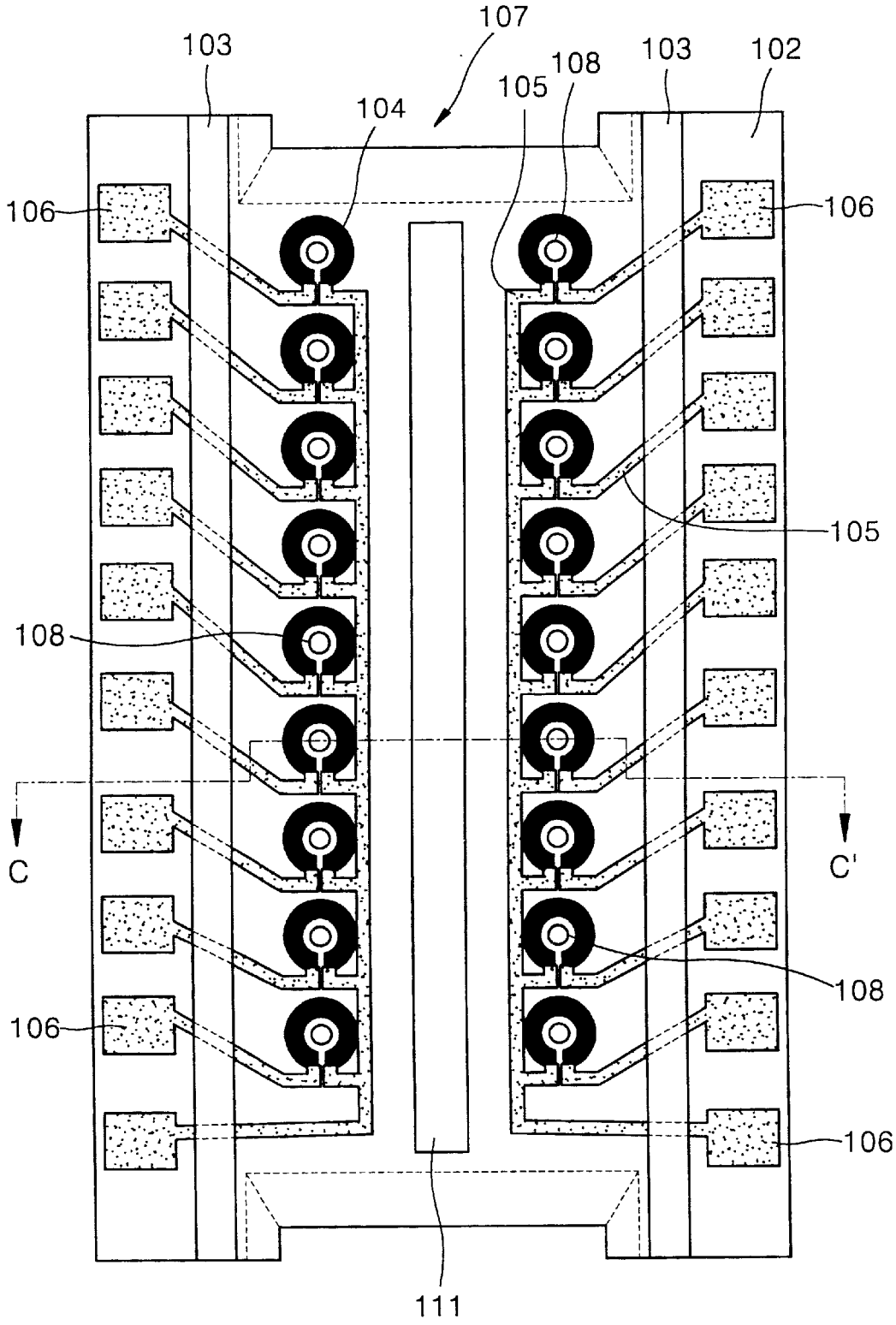
FIG. 16 is a schematic top view of a substrate of a bubble-jet type ink-jet printhead according to a third embodiment of the present invention.
Figure 17:
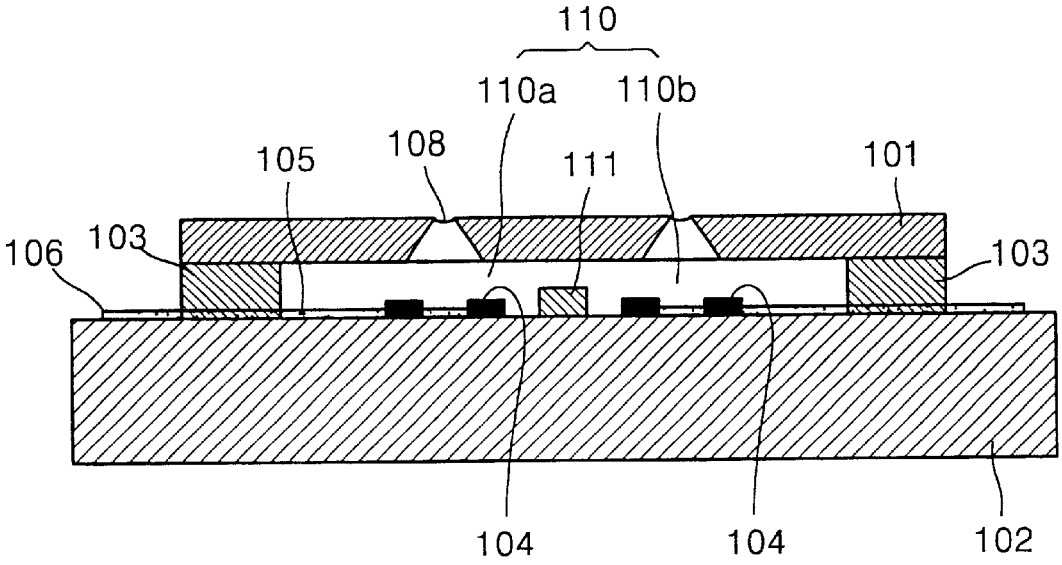
FIG. 17 is a cross-sectional view taken along C–C' of FIG. 16.

For example, as shown in FIG. 16, which is a top view of a substrate in a bubble-jet type ink-jet printhead according to a third embodiment of the present invention, and FIG. 17, which is a cross-sectional view taken along line C–C' of FIG. 16, a stack-type dam 111 having a predetermined height is formed between first and second rows of the resistive layer 104 arranged in two rows, thereby dividing the common chamber 110 into two regions 110*a* and 110*b*. In this case, the fluid resistance of ink flowing over the stack-type dam 111 is larger than that of ink flowing in the other portions of the common chamber, thereby preventing the occurrence of cross-talk between divided regions 110*a* and 110*b*.

Figure 18:
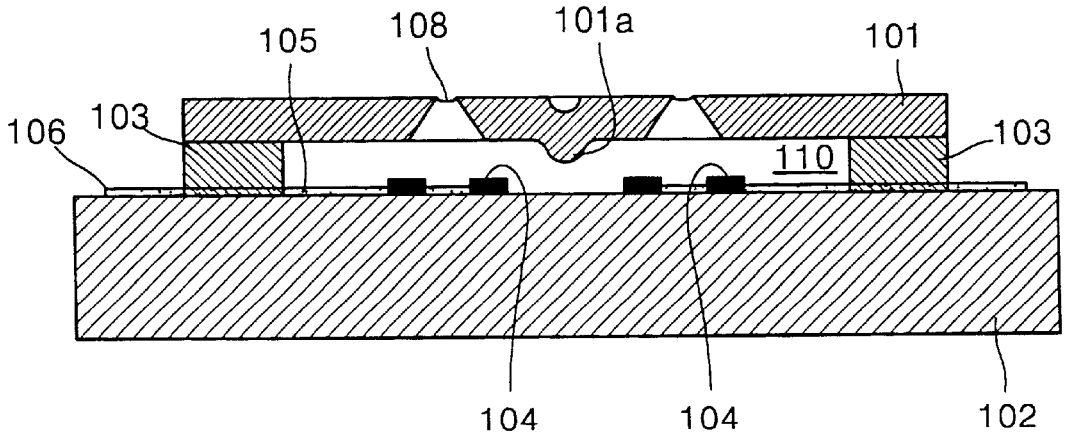
FIG. 18 is a schematic cross-sectional view of a bubble-jet type ink-jet printhead according to a fourth embodiment of the present invention.

Alternatively, the stack-type dam 111 can be replaced with a rib-type dam 101*a* that projects inwardly from the nozzle plate 101 as shown in FIG. 18 showing a cross-section of a bubble-jet type ink-jet printhead according to a fourth embodiment of the present invention.

Figure 19:
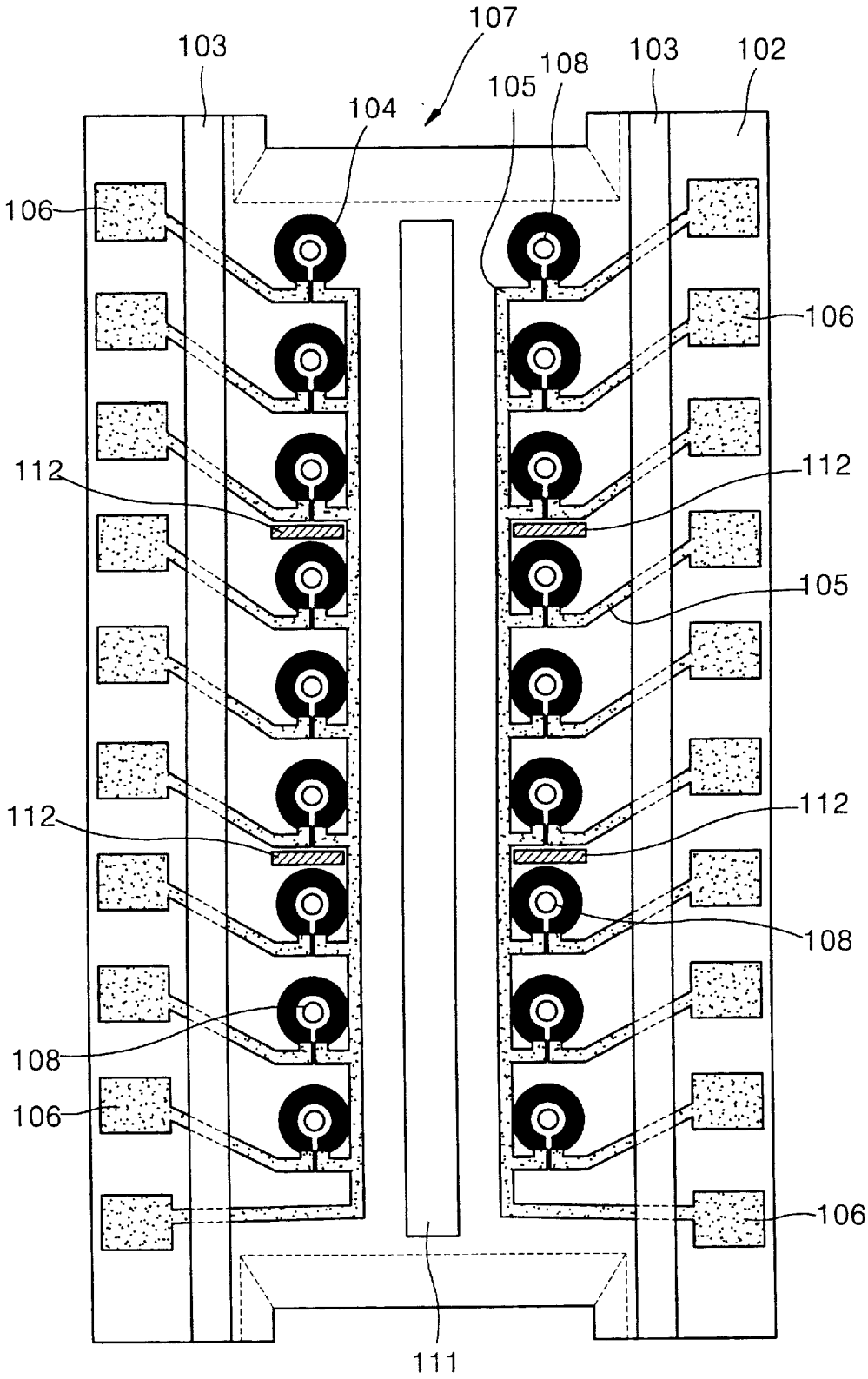
FIG. 19 is a schematic top view of a bubble-jet type ink-jet printhead according to a fifth embodiment of the present invention.

The structure for suppressing cross-talk between regions due to increased fluid resistance may be implemented such that the stack-type dam 111 is formed long between the rows in the longitudinal direction as shown in FIGS. 16 and 17. Alternatively, as shown in FIG. 19, which is a top view of the substrate 102 in a bubble-jet type ink-jet printhead according to a fifth embodiment of the present invention, the regions divided by the stack-type dam 111 may be divided into sub-regions by stack-type dams 112 in the same row.

The stack-type dam 112 or the rib-type dam 101*a* described above may take on a variety of different forms. For example, either of them may be disposed in the vicinity of each resistive layer 104, and in particular, the stack-type dam 112 and the rib-type dam 101*a* may be provided together. The dams 112 and 101*a* help increase fluid resistance to prevent cross-talk between the regions. Especially, when the doughnut-type bubble 401 is formed near the nozzle 108 where ink will be ejected, the dams 112 and 101*a* not only prevent a back flow of ink to adjacent nozzles due to pressure generated by the bubble formation, but also increase ink ejection efficiency at the corresponding nozzle where ink ejection is attempted.

Figure 20:
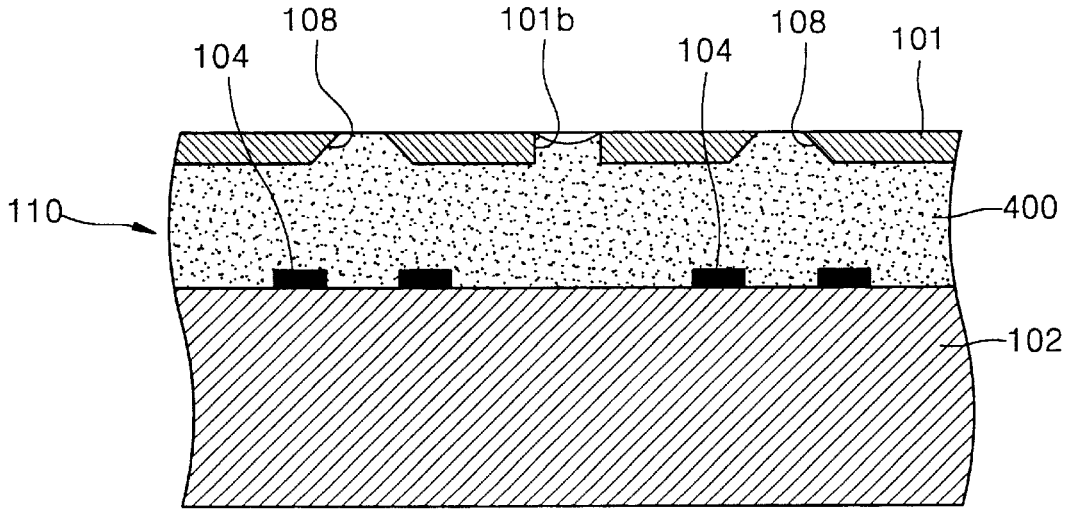
Figure 21:
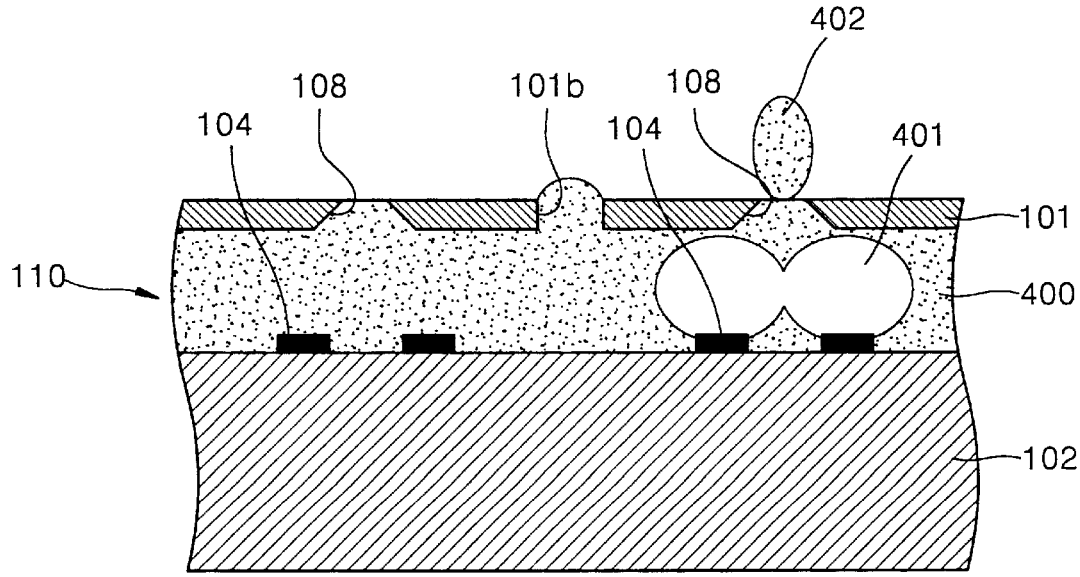

In association therewith, the structure for suppressing cross-talk between the nozzles 108 more effectively is shown in FIG. 20, which is a cross-sectional view showing a portion of the structure of a bubble-jet type ink-jet printhead according to a sixth embodiment of the present invention. Referring to FIG. 20, a damping hole 101*b* is disposed between the nozzles 108 in the nozzle plate 101. The damping hole 101*b* may be disposed in any other portion adjacent to any nozzle 108 as well as between the nozzles 108 as described above. In a normal state, ink 400 fills the common chamber 110, the nozzle 108, and the damping hole 101*b*. As shown in FIG. 21, when attempting an ink ejection due to the formation of the doughnut-shaped bubble 401, as the doughnut-shaped bubble 401 expands, some amount of ink flows back into the adjacent nozzle 108. When the back flow of ink occurs, some amount of ink flows out into the damping hole 101*b* which is open to the outside, thereby suppressing the expansion pressure of the bubble 401 from affecting the adjacent nozzle 108. In this case, the back flow of ink occurs very slightly. This is because frictional loss due to a narrow gap between the nozzle plate 101 and the substrate 102 is sufficiently large to exert most pressure on the outside of the nozzle plate 101 that maintains a relatively low pressure through the nozzle 108 which is the closest to the region where the bubble 401 is actually formed.

The structure hereinbefore described relates to a monochrome ink cartridge. However, the above embodiments of the present invention are applicable to various types of ink cartridges, in particular, a color ink cartridge. For example, these embodiments may be applied to a conventional cartridge for holding ink colors such as yellow, cyan, and magenta in individual cells. In this case, one spatially isolated common chamber should be provided for each color, and furthermore, the common chamber for each color may be divided into small regions as described above.

Figure 22:
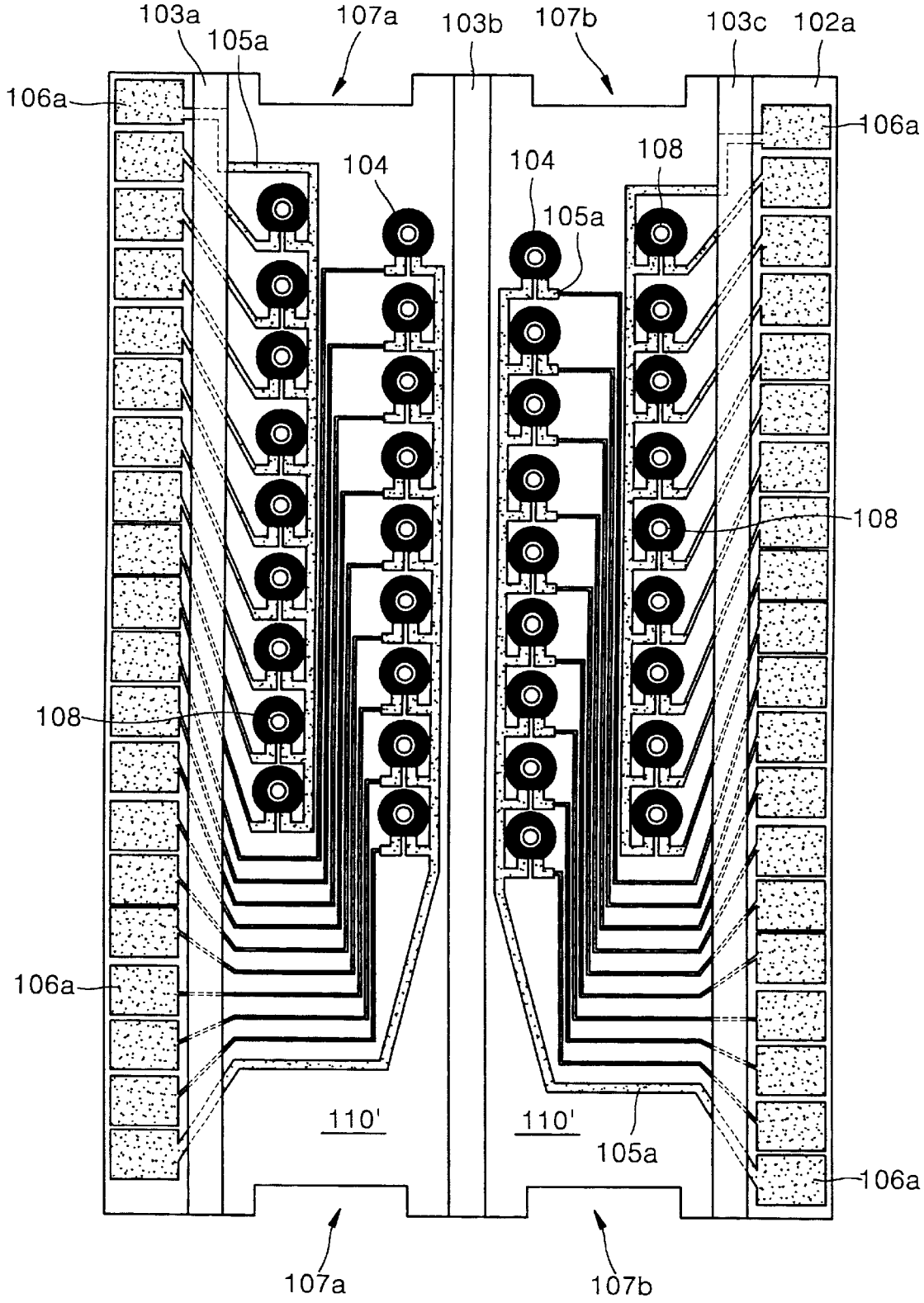
FIG. 22 is a schematic plan view of a substrate of a bubble-jet type ink-jet printhead according to a seventh embodiment of the present invention.

FIG. 22 is a top view of a bubble-jet type ink-jet printhead using two ink colors according to a seventh embodiment of the present invention, as a simple example for showing the structure of the head for multiple colors as described above to aid in understanding.

Pads 106*a* are arranged in two rows along both edges of a substrate 102*a*. Three walls 103*a*, 103*b*, and 103*c* are arranged between the rows of the pads 106*a* in an evenly spaced manner. Two common chambers 110' are provided by the walls 103*a*, 103*b*, and 103*c*. Ink inlet grooves 107*a* and 107*b* are formed at the ends of both common chambers 110'. A resistive layer 104 and a wiring layer 105*a* are formed at the bottom of both common chambers 110'. A nozzle plate (not shown) including a nozzle corresponding to the resistive layer 104 is disposed on the substrate 102*a*.

Figure 23:
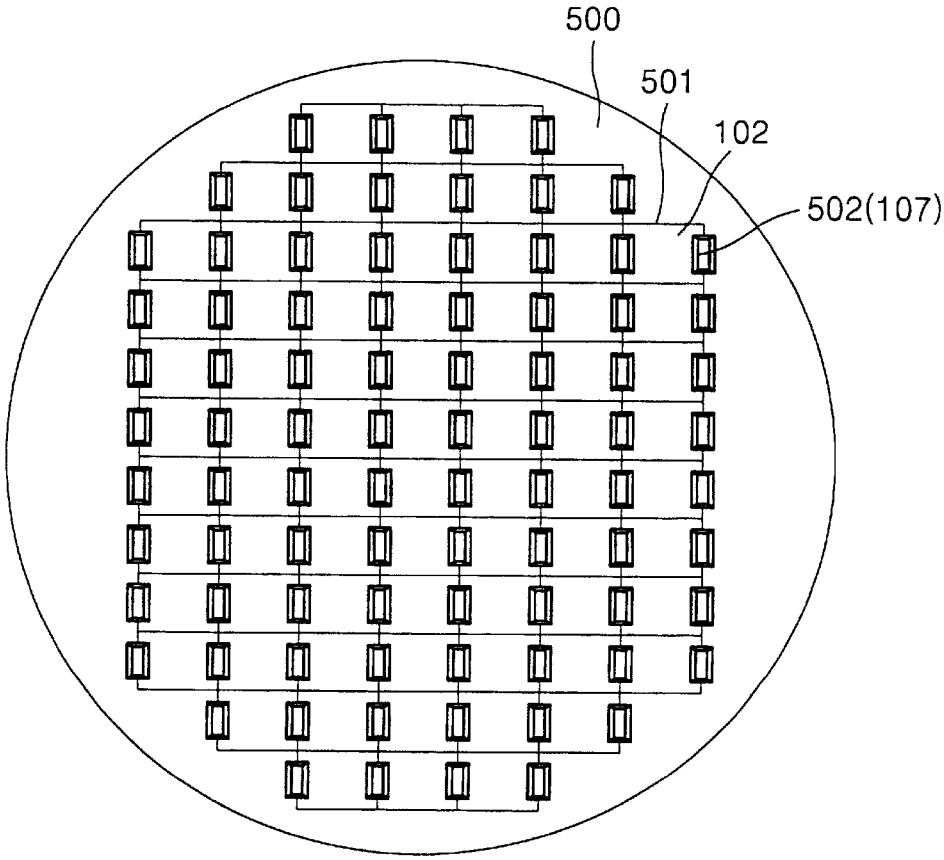
FIG. 23 is a top view of a wafer for fabricating a substrate in manufacturing a bubble-jet type ink-jet printhead according to the present invention.
Figure 24:
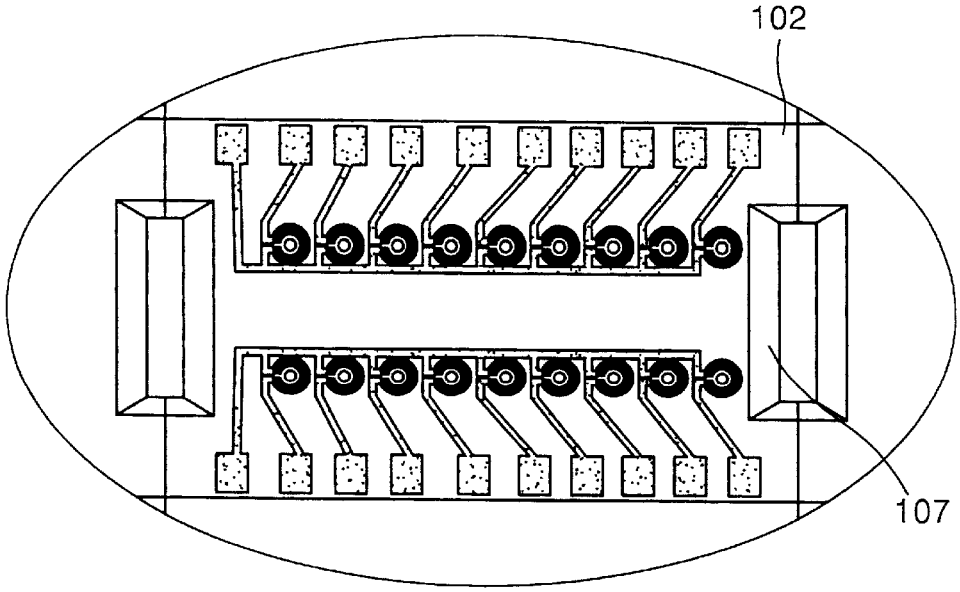
FIG. 24 is an enlarged top view of a portion of the substrate in the wafer shown in FIG. 23.

FIG. 23 pertains to all embodiments of the present invention and illustrates a silicon wafer 500 compactly manufactured in the form corresponding to the substrate 102 along a dicing line 501. In this case, a groove 502 for an ink inlet groove 107 disposed at the ends of the substrate 102 is formed on the dicing line 501. The substrate 102 is separated from the silicon wafer 500 by the dicing line 501 to obtain the unit substrate 102 as shown in FIG. 24. Before separating the substrate 102 along the dicing line 501, a resistive layer, a wiring layer, and a pad are formed on the back surface of the substrate 102 by means of deposition and patterning which are well known in the art. A silicon substrate is used as the wafer 500, and the resistive layer 104 may be formed of p-Si or TaAl.

Specifically, the groove 502 for the ink inlet groove 107 is formed on the front surface of the substrate 102 while the resistive layer, the wiring layer, and the pad are formed on the back surface thereof. The etching of the substrate 102 is performed using $Si_3N_4$ or another thin film as a mask and potassium hydroxide (KOH) or tetrametyl ammonium hydroxide (TMAH) as an etching solution.

The resistive layer 104 is formed by depositing polysilicon over the wafer 500 and then patterning in a annular shape. Specifically, the polysilicon may be deposited to a thickness of about 0.8 μm by low pressure chemical vapor deposition, and then the polysilicon deposited over the entire surface of the wafer 500 is patterned by a photo process using a photomask and photoresist and an etching process using a photoresist pattern as an etch mask.

The groove 502 on the wafer 500 is formed by performing oblique etching or anisotropic etching on one side of the wafer 500. The wiring layer and the pad connected to the resistive layer 104 are formed by depositing a metal having good conductivity such as Al to a thickness of about 1 μm by means of sputtering and patterning the same. In this case, the wiring layer and the pad may be formed of copper by electroplating. Walls on the substrate 102 may be formed by a printing technique.

Figure 25:
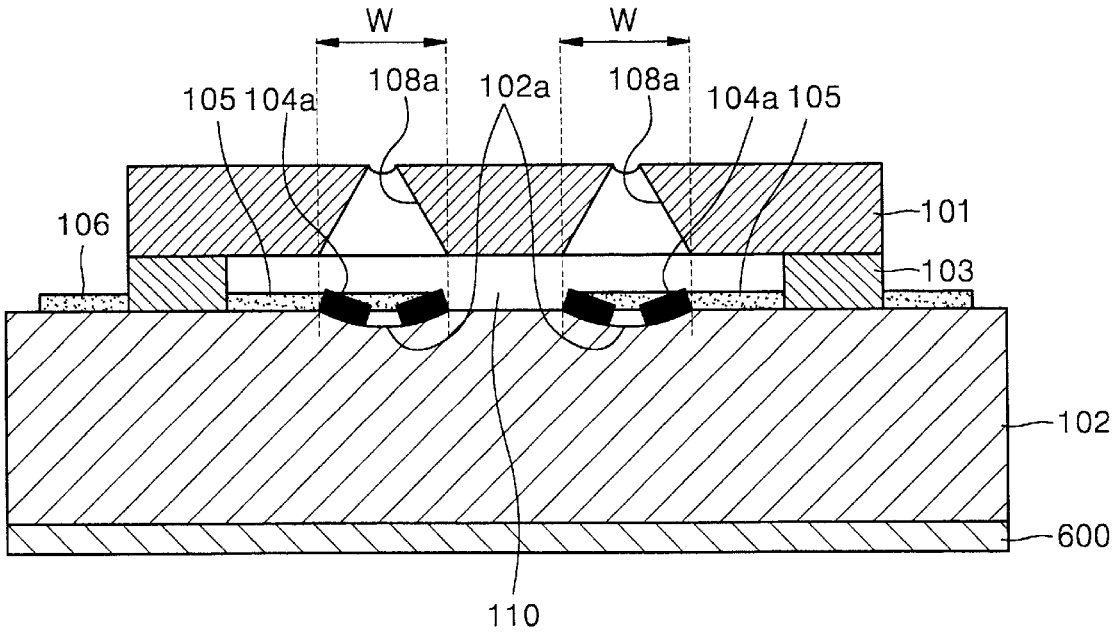
FIGS. 25 and 26 are cross-sectional and longitudinal sectional views of a bubble-jet type ink-jet printhead according to an eighth embodiment of the present invention.

A bubble-jet type ink-jet printhead according to an eighth embodiment of the present invention will now be described. The ink-jet printhead according to this embodiment allows for more effective ink ejection and includes a means for removing foreign materials within an ink chamber while retaining the characteristics of bubble-jet type ink-jet printheads having the structures described above. Referring to FIG. 25, the nozzle plate 101 and the substrate 102 are spaced apart a predetermined distance by the wall 103, and the common chamber 110 shared by all resistive layers 104*a* is provided therebetween. The resistive layer 104*a* is connected to the wiring layer 105 and the pad 106 as in the previous embodiments. Resistive layer 104*a* may be doughnut-shaped as illustrated in FIG. 9, square-shaped as in FIG. 14, or pentagonal-shaped as in FIG. 15. A vibration element 600 such as a piezo element is disposed on the bottom of the substrate 102 as one of the selective elements featured in the present invention, while the resistive layer 104*a* is disposed on the top surface thereof. The resistive layer 104*a* is formed on the bottom of a concave portion 102*a* having a predetermined diameter, formed on the surface of the substrate 102. The concave portion 102*a* is positioned below a nozzle 108*a* with a diameter slightly greater than or equal to the lower diameter W of the nozzle 108*a*. Thus, the top surface of the resistive layer 104*a* is inclined toward an axis passing through the center of the nozzle 108*a* disposed thereabove.

The nozzle plate 101 is formed with a sufficient thickness so that the nozzle 108*a* may be of a sufficient volume. The thus-structured nozzle 108*a* serves both as a space where an ink droplet is ejected and as another unit chamber for holding the ejected ink, and a bubble formed by the resistive layer 104*a* is concentrated within the nozzle 108*a*. Further, along with the structure of the nozzle 108*a*, preferably, the distance between the substrate 102 and the nozzle plate 101, that is, the height of the common chamber 110 is made as small as possible within an allowable range so that the ink may be supplied onto the resistive layer 104*a*. In particular, the height thereof is preferably smaller than the lower diameter W of the nozzle 108*a*. This is for effectively preventing a back flow of the ink when the ink is ejected by bubble formation.

Figure 26:
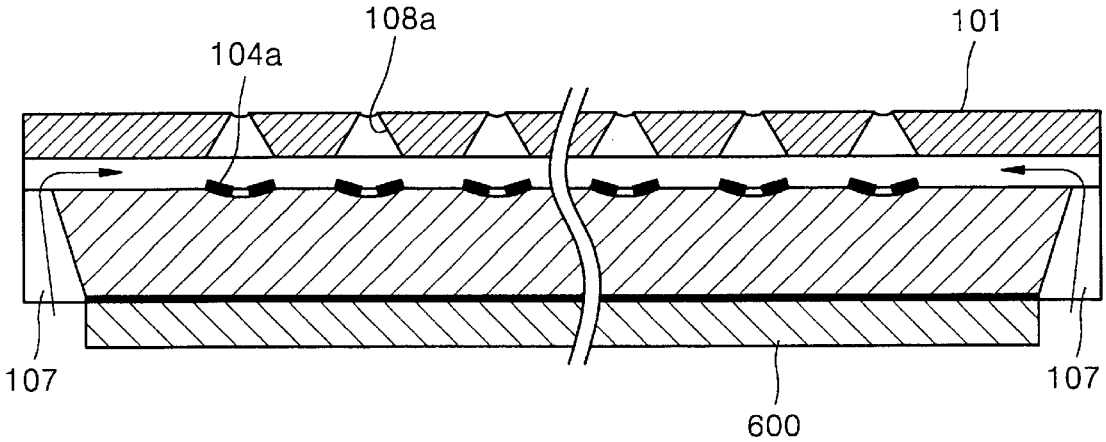
Figure 27:
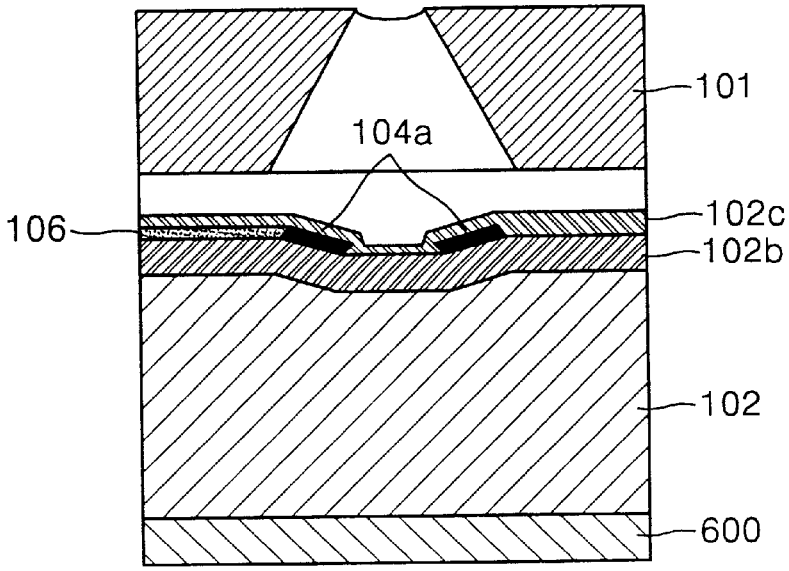
FIG. 27 is an enlarged view of portions of the substrate and the nozzle plate around the heater in the bubble-jet type ink-jet printhead according to the present invention shown in FIGS. 25 and 26.

FIG. 27 is an enlarged view of portions of the substrate and the nozzle plate around the heater in the ink-jet printhead according to the eighth embodiment of the present invention shown in FIGS. 25 and 26. As shown in FIG. 27, an insulating layer 102*b* is formed on the substrate 102 on which the concave portion 102*a* has been formed, on top of which the resistive layer 104*a* is formed. A protective layer 102*c* for preventing the ink from contacting the resistive layer 104*a* is formed on the resistive layer 104*a*.

The insulating layer 102*b* and the protective layer 102*c* may be selectively adopted in all of the previous embodiments. The insulating layer 102*b* works as a thermal resistor for thermal insulation so as to prevent heat generated from the resistive layer 104*a* from being transferred to the substrate 102. The insulating layer 102*b* is formed of materials such as $SiO_2$, and the protective layer 102*c* is formed of a material such as $Si_3N_4$. Meanwhile, the vibration element 600 is disposed on the bottom of the substrate 102. A electrical signal line connected to the vibration element 600 is omitted in the drawing. The vibration element 600 is provided for seceding foreign materials such as ink accumulated from the top surface of the substrate 102. The vibration element 600 may be selectively applied to the previous first through seventh embodiments as well as the eighth embodiment of the present invention.

Furthermore, the structure for concentrating a bubble formed by the resistive layer 104*a* within the nozzle 108*a* may also be applicable to the previous first through seventh embodiments by adjusting the structure of the nozzle 108*a* formed in the nozzle plate 101 and the distance between the nozzle plate 101 and the substrate 102 associated therewith under the conditions described above. Furthermore, all applicable elements in the first through seventh embodiments previously mentioned, such as the structure for preventing a back flow of ink, may be selectively adopted in this embodiment.

Figure 28A:
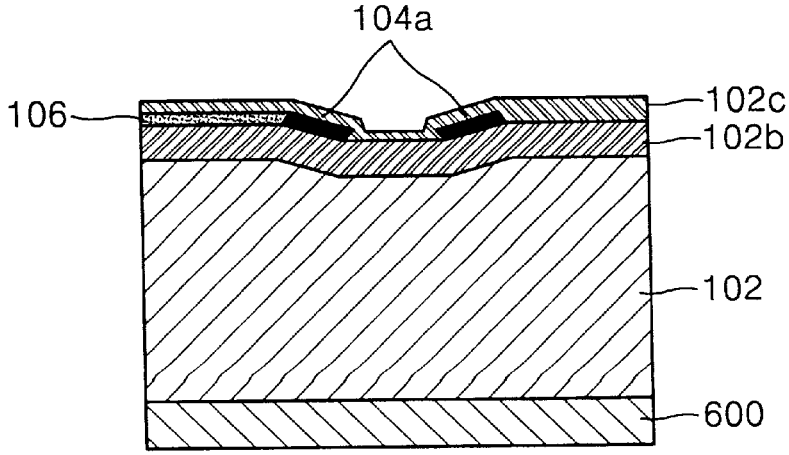
FIGS. 28A–28F show a process of fabricating the bubble-jet type ink-jet printhead according to the present invention shown in FIGS. 25–27.
Figure 28B:
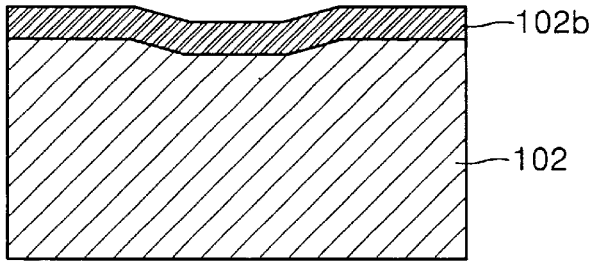
Figure 28C:
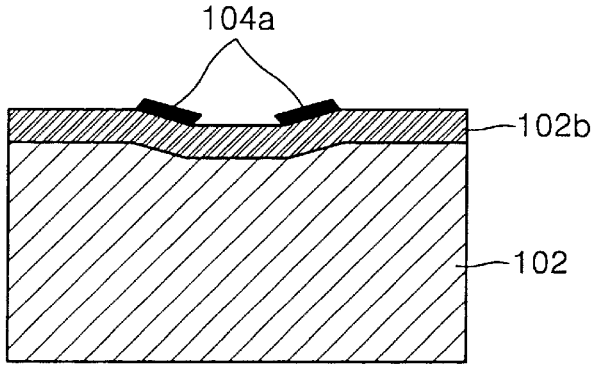
Figure 28D:
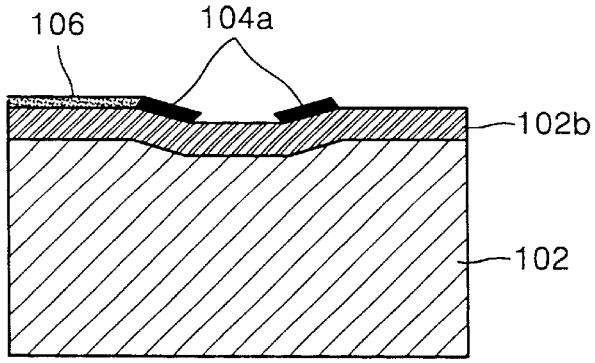
Figure 28E:
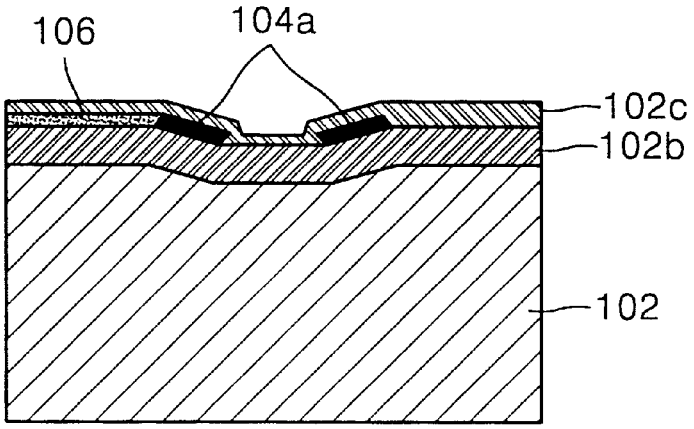
Figure 28F:
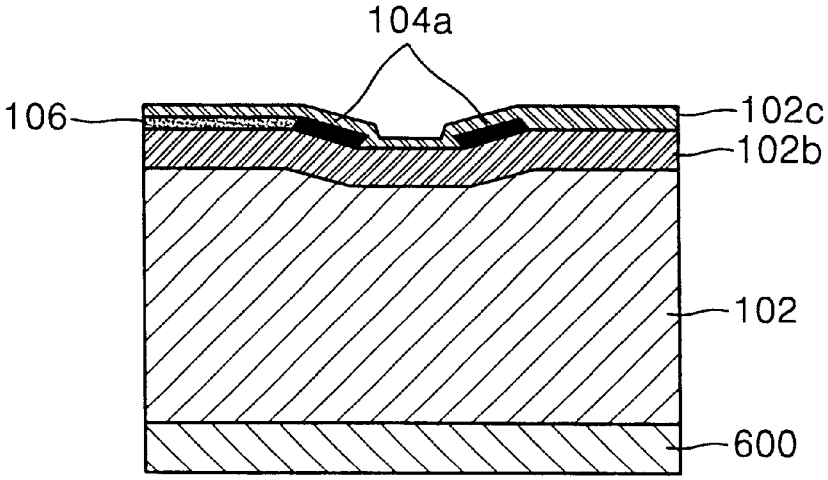

A part of a process of fabricating the ink-jet printhead according to the eighth embodiment of the present invention will now be described. As shown in FIG. 28A, the concave portion 102*a* is formed on the substrate 102. As previously mentioned, the plurality of concave portions 102*a* are formed opposite the nozzles 108*a* of the nozzle plate 101. As shown in FIG. 28B, the insulating layer 102*b* made of $SiO_2$ is deposited over the top surface of the substrate 102. As shown in FIG. 28C, the resistive layer 104*a* positioned on the concave portion 102*a* is formed through a predetermined process. As shown in FIG. 28D, a signal line 106 connected to the resistive layer 104*a* is formed of gold, copper, or aluminum on the insulating layer 102B. As shown in FIG. 28E, the protective layer 102*c* made of $Si_3N_4$ is deposited on the laminate structure. As shown in FIG. 28F, the vibration element 600 is formed of a piezo element on the bottom of the substrate 102. After fabrication of the substrate 102 is complete through the above processes, the nozzle plate 101 provided through a separate process is fixed to the top surface of the substrate 102, thereby completing the ink-jet printhead having laminate and combination structures as shown in FIGS. 25–27.

Figure 29:
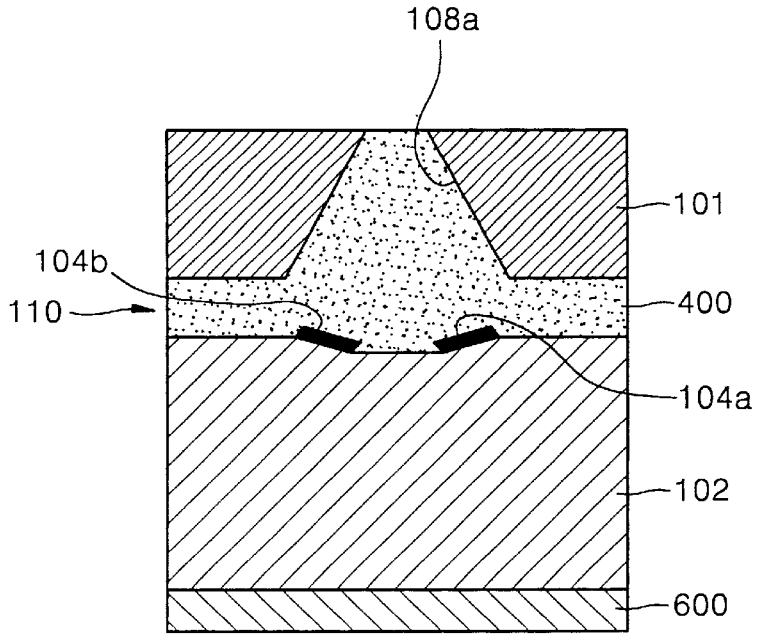
FIGS. 29–32 are schematic cross-sectional views showing the formation and growth of a doughnut-shaped bubble, ejection of an ink droplet, and shrinkage of the bubble in the bubble-jet type ink-jet printhead according to the present invention shown in FIGS. 25–27.

Next, the steps of an ink ejection process in the ink-jet printhead according to the eighth embodiment of the present invention will be described. FIGS. 29–32 shows the stages associated with the formation and growth of the doughnut-shaped bubble 401 by the resistive layer 104*a*, ejection of an ink droplet, and shrinkage of the bubble. In FIG. 29, the resistive layer 104*a* is electrically unloaded, and thus ink 400 fills the common chamber 110. The ink 400 is supplied to the common chamber 110 by capillary action. In particular, a greater amount of the ink 400 than is necessary for ejection fills the nozzle 108*a*.

Figure 30:
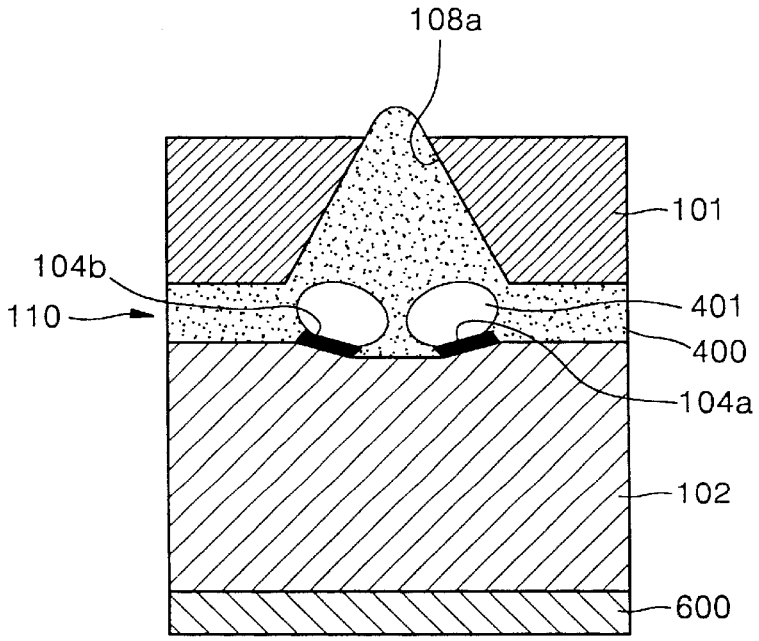

FIG. 30 shows a state in which the doughnut-shaped bubble 401 is formed by the resistive layer 104*a*, to which a DC pulse is applied. Here, as shown in FIG. 30, the ink 400 below the nozzle 108*a* is isolated and then compressed by the bubble 401. Thus, the doughnut-shaped bubble 401 forms an isolated virtual chamber within the common chamber 110 shared by the nozzles 108*a*. In particular, the lower portion of the nozzle 108*a* begins to be closed by the bubble 401 and then pressure is exerted on the ink 400 within the nozzle 108*a*, thereby causing the ink to be ejected through the corresponding nozzle 108*a*.

Figure 31:
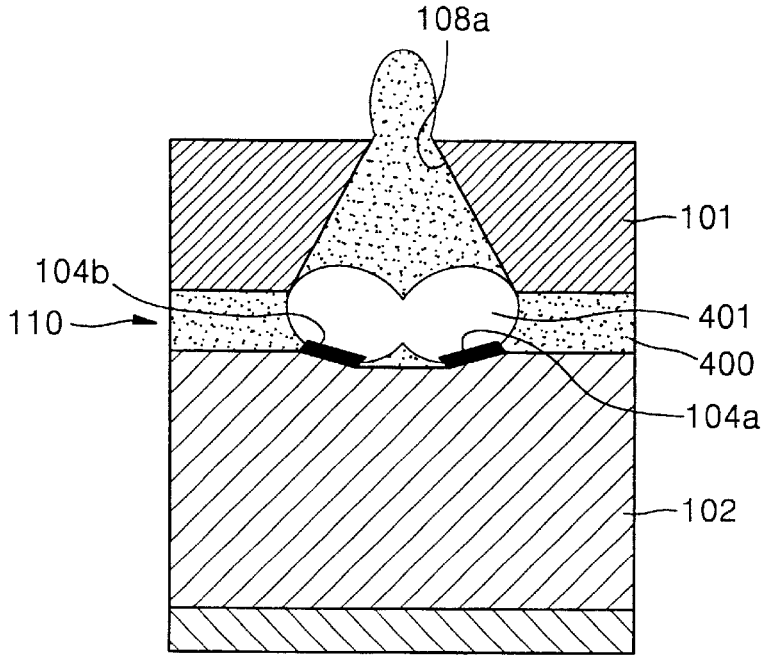
Figure 32:
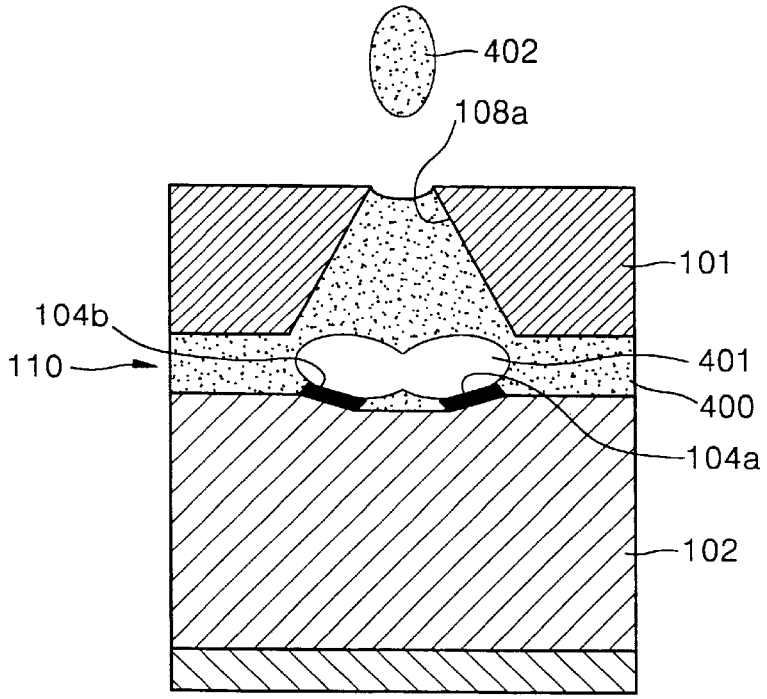

FIG. 31 shows a state in which the doughnut-shaped bubble 401 formed by the resistive layer 104*a* has reached its maximum growth. The volume of the virtual chamber formed by the doughnut-shaped bubble 401 is reduced to a minimum by the maximum growth of the doughnut-shaped bubble 401, and in particular the lower portion of the nozzle 108*a* is completely closed. Pressure by the continuously expanding bubble 401 causes the ink 400 within the nozzle 108*a* to be ejected through the nozzle 108*a*. FIG. 32 shows a state in which the bubble 401 has been shrunk after the ejection of an ink droplet 402 through the nozzle 108*a*. As the bubble 401 shrinks, the ink 400 begins to refill, which returns to the state shown in FIG. 29. The shrinkage of the bubble 401 is caused by the cooling of the resistive layer 104 due to the cutoff of a DC pulse.

Based on the foregoing, a bubble-jet type ink-jet printhead according to the present invention is constructed such that the space between the nozzle plate and the substrate forms a common chamber and there is no ink channel having a complicated structure, thereby significantly suppressing the clogging of nozzles by foreign materials or solidified ink.

The ink-jet printhead according to the present invention is easy to design and manufacture due to its simple structure thereby significantly reducing the manufacturing cost. In particular, its simple structure permits flexibility in selecting a wide range of alternative designs and thus patterns in which the nozzles are arranged. In particular, the printhead according to the present invention can be manufactured by a fabrication process for a typical semiconductor device, thereby facilitating high volume production.

Furthermore, the virtual chamber formed by the doughnut-shaped bubble prevents a back flow of ink thereby avoiding cross-talk between adjacent nozzles. In particular, ink refills the virtual chamber for each nozzle from every direction, thereby allowing for continuous high-speed ink ejection.

The ink-jet printhead according to the present invention guarantees a quick response rate and high driving frequency. Furthermore, the doughnut-shaped bubble coalesces at the center of the nozzle, thereby preventing the formation of satellite droplets.

It should be understood that the present invention is not limited to the particular embodiments disclosed herein as the best mode contemplated for carrying out the present invention, but rather that the present invention is not limited to the specific embodiments described in this specification except as defined in the appended claims.

What is claimed is:

1. A bubble-jet type ink-jet printhead, comprising:

a substrate;

a nozzle plate perforated by a plurality of nozzles, said nozzle plate being separated a predetermined distance from the substrate;

walls for closing a space between the substrate and the nozzle plate and forming a single common chamber between the substrate and the nozzle plate;

a plurality of concave portions formed in a top surface of the substrate and disposed in said common chamber corresponding to of said plurality of nozzles;

a plurality of resistive layers disposed in said single common chamber, each one of said plurality of resistive layers being disposed in corresponding ones of said plurality of concave portions formed in said substrate and disposed in said single common chamber, each one of said plurality of resistive layers surrounding corresponding ones of a plurality of central axes passing through a center of corresponding ones of said plurality of nozzles;

a plurality of pairs of wiring layers formed on the substrate, each pair of wiring layers being connecting to each resistive layer and extending to an outside of the common chamber; and a plurality of pads disposed at the outside of the common chamber on the substrate and electrically connected to ones of said plurality of wiring layers, said common chamber being coextensive with said plurality of nozzles and said plurality of resistive layers corresponding to said plurality of nozzles said printhead comprising only said single common chamber.

2. The printhead of claim 1, the plurality of resistive layers are formed in two or more rows on the substrate.

3. The printhead of claim 1, the plurality of nozzles are formed in two or more rows on the substrate.

4. The printhead of claim 1, further comprising a thermal insulating layer being disposed on top of the substrate and each of said plurality of resistive layers being formed on top of the insulating layer.

5. The printhead of claim 1, further comprising a protective layer disposed on top of each of said plurality of resistive layers in said common chamber in said printhead, said protective layer protecting each of said plurality of resistive layers from degradation caused by contact with ink in the common chamber.

6. The printhead of claim 1, a diameter of a lower portion of each of said plurality of nozzles being greater than or equal to a diameter of each of said plurality of concave portions.

7. The printhead of claim 1, further comprising a vibration element disposed on a bottom of the substrate.

8. The printhead of claim 1, each one of said plurality of resistive layers having a doughnut-shape, one side of which is open.

9. The printhead of claim 1, each one of said plurality of resistive layers having a pentagonal shape, one side of which is open.

10. The printhead of claim 1, said entire printhead comprising only two ink feed grooves in said substrate for supplying ink to the common chamber and each of said plurality of resistive layers, said two ink feed grooves being disposed at opposite ends of said substrate.

11. The printhead of claim 1, further comprising a long stack-type dam built on said substrate, said stack type dam separating one half of said plurality of nozzles on said printhead from each other, a gap being present between a top of said dam and said nozzle plate.

12. The printhead of claim 1, further comprising a plurality of short stack type dams, each stack type dam being disposed on said substrate, a gap being present between said nozzle plate and a top of each dam, each dam separating only one of a plurality of nozzles from another nozzle.

13. The printhead of claim 1, said nozzle plate being further perforated by a plurality of dampening holes disposed between a pair of nozzle holes to prevent crosstalk between said pair of nozzles.

14. The printhead of claim 1, further comprising a vibration element disposed on a bottom side of said substrate.

15. A bubble-jet type ink-jet printhead, comprising:

a substrate;

a nozzle plate perforated by a first plurality of nozzles in a second plurality of nozzle rows, each of said second plurality of rows being parallel to each other, said nozzle plate being separated a predetermined space from the substrate;

a long stack type dam disposed on said substrate and along a length of said substrate and parallel to said second plurality of rows, said long stack type dam having an equal number of nozzle rows on each side of said long stack type dam;

walls for closing the space between the substrate and the nozzle plate and then forming a single common chamber between the substrate and the nozzle plate;

a plurality of concave portions formed in the substrate corresponding to the nozzles;

a plurality of resistive layers, each one of said plurality of resistive layers being disposed in corresponding ones of said plurality of concave portions formed in said substrate, each one of said plurality of resistive layers surrounding corresponding ones of a plurality of central axes passing through a center of corresponding ones of said plurality of nozzles;

a plurality of pairs of wiring layers formed on the substrate, each pair of wiring layers being connecting to each resistive layer and extending to the outside of the common chamber; and a plurality of pads which are disposed at the outside of the common chamber on the substrate and electrically connected to the wiring layers, said common chamber serving each of said plurality of nozzles, each of said plurality of resistive layers corresponding to said plurality of nozzles, and said substrate comprising only said single common chamber.

16. The printhead of claim 15, further comprising a pair of ink feed grooves disposed at opposite ends of said substrate and perforating said substrate, said pair of ink feed grooves serving to replenish ink to said common chamber serving each of said plurality of nozzles.

17. The printhead of claim 15, further comprising a plurality of short stack type dams, each of said short stack type dams disposed on said substrate and being disposed between a pair of nozzles on a same row of nozzles.

18. The printhead of claim 17, each of said plurality of short stack type dams protruding towards a bottom side of said nozzle plate from said substrate while leaving a gap between a bottom side of said nozzle plate and a top of each of said plurality of short stack type dams.

19. The printhead of claim 15, said long stack type dam protruding towards a bottom side of said nozzle plate from said substrate while leaving a gap between a bottom side of said nozzle plate and a top of said long stack type dam.

20. The printhead of claim 15, said nozzle plate further being perforated by a plurality of dampening holes, each of said plurality of dampening holes being disposed between a pair of said plurality of nozzles holes, each of said plurality of dampening holes being absent of a resistive layer disposed on said substrate beneath any one of said plurality of dampening holes.

21. A bubble-jet type ink-jet printhead, comprising:

a substrate, said substrate having a perimeter defining a boundary of a single common chamber;

a nozzle plate perforated by a plurality of nozzles, said nozzle plate being separated a predetermined space from the substrate;

a pair of walls disposed on said perimeter of said substrate connecting said substrate to said nozzle plate and closing the space between the substrate and the nozzle plate and forming said single common chamber between the substrate and the nozzle plate, each one of said pair of walls facing each other, each one of said pair of walls being disposed at opposite ends of said substrate;

a plurality of concave portions formed in the substrate corresponding to the nozzles;

a plurality of resistive layers, each one of said plurality of resistive layers being disposed in corresponding ones of said plurality of concave portions formed in said substrate, each one of said plurality of resistive layers surrounding corresponding ones of a plurality of central axes passing through a center of corresponding ones of said plurality of nozzles;

a plurality of pairs of wiring layers formed on the substrate, each pair of wiring layers being connecting to each resistive layer and extending to an outside of the common chamber;

a pair of ink feed grooves disposed on a perimeter of said substrate and perforating through said substrate, each one of said pair of ink feed grooves being disposed between said pair of walls, said pair of ink feed grooves being an only source for supplying ink to said common chamber and each of said plurality of nozzles; and a plurality of pads which are disposed at the outside of the common chamber on the substrate and electrically connected to the wiring layers, said common chamber serving each of said plurality of nozzles, said plurality of resistive layers corresponding to said plurality of nozzles, and said substrate comprising only said single common chamber.

22. The printhead of claim 21, further comprising a long stack type dam disposed on said substrate and along a length of said substrate, said long stack type dam having an equal number of nozzles on each side of said long stack type dam.

23. The printhead of claim 22, further comprising a plurality of short stack type dams, each of said short stack type dams disposed on said substrate and being disposed between a pair of nozzles.

24. The printhead of claim 23, each one of said plurality of short stack type dams protruding towards a bottom side of said nozzle plate from said substrate while leaving a gap between a bottom side of said nozzle plate and a top of each of said plurality of short stack type dams.

25. The printhead of claim 22, said long stack type dam protruding towards a bottom side of said nozzle plate from said substrate while leaving a gap between a bottom side of said nozzle plate and a top of said long stack type dam.

26. The printhead of claim 21, said nozzle plate further being perforated by a plurality of dampening holes, each of said plurality of dampening holes being disposed between a pair of said plurality of nozzles holes, each of said plurality of dampening holes being absent of a resistive layer disposed beneath corresponding ones of said plurality of dampening holes.

* * * * *